US011290795B2

(12) United States Patent
Karnavas et al.

(10) Patent No.: US 11,290,795 B2
(45) Date of Patent: Mar. 29, 2022

(54) COAXIAL LOUDSPEAKERS WITH PERFORATED WAVEGUIDE

(71) Applicant: Bose Corporation, Framingham, MA (US)

(72) Inventors: Benjamin Grant Karnavas, Providence, RI (US); Greg J. Zastoupil, Norh Grafton, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 16/415,416

(22) Filed: May 17, 2019

(65) Prior Publication Data

US 2020/0366978 A1 Nov. 19, 2020

(51) Int. Cl.
*H04R 1/02* (2006.01)
*H04R 1/32* (2006.01)

(52) U.S. Cl.
CPC ..... *H04R 1/025* (2013.01); *H04R 1/323* (2013.01)

(58) Field of Classification Search
CPC ..... H04R 1/02; H04R 1/025; H04R 1/026; H04R 1/20; H04R 1/22; H04R 1/24; H04R 1/26; H04R 1/28; H04R 1/2803; H04R 1/2807; H04R 1/2811; H04R 1/2815; H04R 1/2819; H04R 1/2823; H04R 1/2826; H04R 1/30; H04R 1/32; H04R 1/323; H04R 1/34; H04R 1/345; H04R 1/36; H04R 2400/07; H04R 2201/00; H04R 2201/02; H04R 2201/025
See application file for complete search history.

(56) References Cited

U.S. PATENT DOCUMENTS 2,107,757 A * 2/1938 Kinsley ..... H04R 1/24 381/343
3,991,286 A 11/1976 Henricksen
4,042,778 A * 8/1977 Clinton ..... H04R 1/02 381/182

(Continued)

FOREIGN PATENT DOCUMENTS

EP 0429121 A1 5/1991
EP 3205113 A1 8/2017
WO 2016055687 A1 4/2016

OTHER PUBLICATIONS

International Search Report and Written Opinion dated Sep. 1, 2020 for PCT/US2020/029148.

(Continued)

*Primary Examiner* — Walter F Briney, III
(74) *Attorney, Agent, or Firm* — Bose Corporation

(57) ABSTRACT

A loudspeaker includes a cabinet, a coaxial transducer assembly, and a waveguide. The coaxial transducer assembly includes a first transducer and a second transducer that is coupled to the first transducer and arranged such that respective motion axes of the transducers are coaxial. The waveguide is coupled to the first transducer and configured to provide an acoustic impedance match between the first transducer and free air. The waveguide includes a first plurality of apertures that enables acoustic energy radiated from a first radiating surface of the second transducer to pass through the waveguide and merge with acoustic energy radiated by the first transducer. The first plurality of apertures extends through an expansion region of the waveguide.

23 Claims, 20 Drawing Sheets

(56) References Cited

U.S. PATENT DOCUMENTS

| | | | | |
|---|---|---|---|---|
| 4,552,242 | A * | 11/1985 | Kashiwabara | H04R 1/24 181/144 |
| 4,619,342 | A * | 10/1986 | Buck | H04R 9/063 181/144 |
| 5,268,538 | A | 12/1993 | Queen | |
| 6,411,718 | B1 | 6/2002 | Danley et al. | |
| 7,039,211 | B2 | 5/2006 | Werner | |
| 7,134,523 | B2 | 11/2006 | Engebretson | |
| 7,873,178 | B2 | 1/2011 | Steere et al. | |
| 7,940,952 | B2 | 5/2011 | Regl | |
| 8,036,408 | B2 | 10/2011 | Voishvillo | |
| 8,077,897 | B2 | 12/2011 | Voishvillo | |
| 8,130,994 | B2 | 3/2012 | Button et al. | |
| 8,181,736 | B2 | 5/2012 | Sterling et al. | |
| 8,259,981 | B2 | 9/2012 | Danley | |
| 8,280,091 | B2 | 10/2012 | Voishvillo | |
| 8,418,802 | B2 | 4/2013 | Sterling et al. | |
| 8,422,712 | B2 | 4/2013 | Danley | |
| 8,457,341 | B2 | 6/2013 | Danley | |
| 8,488,826 | B2 | 7/2013 | Danley | |
| 8,607,922 | B1 | 12/2013 | Werner | |
| 8,649,544 | B2 | 2/2014 | Voishvillo | |
| 8,672,088 | B2 | 3/2014 | Sterling et al. | |
| 8,842,867 | B2 | 9/2014 | Bothe | |
| 8,967,323 | B1 * | 3/2015 | Grenier | H04R 1/403 181/199 |
| 9,571,923 | B2 | 2/2017 | Spillmann et al. | |
| 9,749,735 | B1 | 8/2017 | Silver et al. | |
| 10,034,081 | B2 | 7/2018 | Tipparaju et al. | |
| 10,038,954 | B2 | 7/2018 | Voishvillo | |
| 10,397,693 | B1 * | 8/2019 | Tao | H04R 1/2811 |
| 2002/0014369 | A1 | 2/2002 | Engebretson | |
| 2004/0222038 | A1 * | 11/2004 | Nakamura | H04R 1/02 181/199 |
| 2005/0169494 | A1 * | 8/2005 | Stiles | H04R 1/02 381/337 |
| 2006/0285712 | A1 | 12/2006 | Butler | |
| 2009/0136072 | A1 | 5/2009 | Danley | |
| 2009/0310808 | A1 * | 12/2009 | Button | H04R 1/24 381/339 |
| 2013/0251188 | A1 * | 9/2013 | Hatton | H04R 1/02 381/390 |
| 2014/0050345 | A1 * | 2/2014 | Hilderman | H04R 1/026 381/332 |
| 2015/0014089 | A1 * | 1/2015 | Sprinkle | H04R 1/30 181/192 |
| 2017/0195783 | A1 | 7/2017 | Gladwin et al. | |
| 2017/0311075 | A1 | 10/2017 | Vaisanen et al. | |
| 2018/0027321 | A1 | 1/2018 | Jaguste | |
| 2019/0090049 | A1 | 3/2019 | Xie et al. | |
| 2020/0177988 | A1 | 6/2020 | Zastoupil et al. | |

OTHER PUBLICATIONS

International Search Report and Written Opinion for Application No. PCT/US2019/063042, dated Mar. 12, 2020.

* cited by examiner

COAXIAL LOUDSPEAKERS WITH PERFORATED WAVEGUIDE

BACKGROUND

This disclosure relates to loudspeakers.

With reference to FIG. 1, a traditional two-way loudspeaker 100 uses separate low and high frequency transducers 102 and 104, respectively. The transducers 102, 104 are arranged such that their respective motion axes are parallel but are spaced apart from each other. This allows for a large waveguide 106 to be attached to the high frequency transducer 104 to optimize consistency of the frequency response in the coverage area. A downside to this design is it can result in inconsistent coverage 200 in one axis (see FIG. 2) due to the asymmetry of the design which is most apparent in the near field when used as a monitor.

Transducer development has advanced to produce coaxial transducers that put the both the low and high frequency in the same axis. This is a better design for symmetry but often involves use of the cone/diaphragm of the low-frequency transducer as a waveguide which is not optimized for high frequency distribution and can also introduce intermodulation distortion at high sound pressure levels, or a waveguide can be attached to the high frequency section, but this then blocks some of the cone area on the low frequency section.

Alternative coaxial designs make use of a separate waveguide, i.e., a waveguide that is separate from the diaphragm of the low-frequency driver. However, such configurations are not without their own drawbacks. For example, using a small waveguide for a coaxial device allows low frequency energy to go around the waveguide but the high frequency performance consistency is compromised, as shown in FIGS. 3A & 3B illustrating measure results for a loudspeaker having a coaxial transducer with a small waveguide. In this case, "small waveguide" refers to a waveguide in which a diameter of the waveguide at its mouth is smaller than an outer diameter of the LF transducer cone/diaphragm. Referring to FIGS. 3A & 3B, the use of a small waveguide results in inconsistent high frequency beamwidth cross the frequency range visible by the color change marking intensity vs. the white lines showing the target coverage limits.

Using a larger waveguide achieves more consistent high frequency response in the coverage area and allows coverage control to a lower frequency but a larger waveguide blocks the cone area of the low-frequency driver, which causes lobing of the low frequency energy and inconsistent summation of the passbands on vs. off axis of the loudspeaker (see FIGS. 4A & 4B). In this case, "large waveguide" refers to a waveguide in which a diameter of the waveguide at its mouth is the same or larger than an outer diameter of the LF transducer cone/diaphragm. The data supplied for the polar surface plots in FIGS. 4A & 4B was of a waveguide that is actually the size of the LF transducer cone. Another issue with large waveguides in a coaxial design is the loss of internal acoustic volume of the loudspeaker due to the need to move the transducer deeper into the cabinet to accommodate the waveguide height. This loss of acoustic volume results in less bandwidth/extension in the low passband. With reference to FIGS. 5A & 5B, by way of comparison, a larger waveguide 500' (FIG. 5B) reduces internal volume 502, 502' compared to smaller waveguide 500 (FIG. 5A) if outer dimensions of the cabinet 504 are kept the same.

SUMMARY

All examples and features mentioned below can be combined in any technically possible way.

In one aspect, a loudspeaker includes a cabinet, a coaxial transducer assembly that is supported in the cabinet, and a waveguide that is coupled to the cabinet. The coaxial transducer assembly includes a first transducer, and a second transducer that is coupled to the first transducer. The second transducer is arranged such that respective motion axes of the first and second transducers are coaxial. The waveguide is coupled to the first transducer and configured to provide an acoustic impedance match between the first transducer and free air. The waveguide includes a first plurality of apertures that enables acoustic energy radiated from a first radiating surface of the second transducer to pass through the waveguide and merge with acoustic energy radiated by the first transducer. The first plurality of apertures extends through an expansion region of the waveguide.

Implementations may include one of the following features, or any combination thereof.

In some implementations, a shape of the waveguide controls a radiation pattern of acoustic energy radiated through the waveguide from the first transducer.

In certain implementations, a positioning of the first plurality of apertures in the waveguide control a radiation pattern of acoustic energy radiated through the first plurality of apertures from the first radiating surface of the second transducer.

In some cases, the first plurality of apertures is configured such that a radiation pattern of acoustic energy radiated by the first radiating surface of the second transducer substantially matches a radiation pattern of acoustic energy radiated through the waveguide from the first transducer at a reference location. In some examples, this reference location includes any location approximately ten (10) meters in front of the loudspeaker within a lateral distance defined by the coverage pattern, or beamwidth of the loudspeaker. In certain examples, the beamwidth of the loudspeaker can range between approximately 10 degrees and approximately 140 degrees.

In certain cases, the second transducer operates below a low-frequency cutoff of the waveguide, such that there is no horn loading on the second transducer via the waveguide.

In some examples, the waveguide does not provide an acoustic impedance match between the second transducer and free air.

In certain examples, the first plurality of apertures is configured such that different radiation patterns are provided along different axes.

In some implementations, the first plurality of apertures is configured such that, for acoustic energy radiated from the second transducer, a first radiation pattern is provided in a first axial direction and a second, wider radiation pattern is provided in a second axial direction.

In certain implementations, the waveguide is shaped such that, for acoustic energy radiated from the first transducer, a first radiation pattern is provided in a first axial direction and a second, wider radiation pattern is provided in a second axial direction.

In some cases, the loudspeaker also includes a plurality of pole mounts supported on the cabinet and the loudspeaker is configured to have a first radiation pattern in a first axial direction and a second radiation pattern, wider than the first radiation pattern, in a second axial direction orthogonal to the first axial direction. A first one of the pole mounts allows the loudspeaker to be mounted to a vertically oriented pole such that the second radiation pattern is arranged in a horizontal direction, and a second one of the pole mounts allows the loudspeaker to be mounted to the vertically oriented pole such that the second radiation pattern is arranged in a vertical direction.

In certain cases, a third one of the pole mounts allows the loudspeaker to be mounted to the vertically oriented pole such that the second radiation pattern is arranged in the vertical direction.

In some examples, the first one of the pole mounts is supported on a first surface of the cabinet, the second one of the pole mounts is supported on a second surface of the cabinet adjacent to the first surface, and the third one of the pole mounts in support on a third surface of the cabinet opposite the second surface.

In certain examples, the loudspeaker also includes a Helmholtz resonator is acoustically coupled to the first radiating surface of the second transducer.

In some implementations, the first transducer is a tweeter and the second transducer is a woofer.

In certain implementations, the loudspeaker includes a third transducer disposed between the first transducer and the second transducer and arranged such that respective motion axes of the first, second, and third transducers are coaxial.

In some cases, the loudspeaker includes a second plurality of apertures that enables acoustic energy radiated from a first radiating surface of the third transducer to pass through the waveguide and merge with acoustic energy radiated by the first and second transducers.

In certain cases, A first acoustic seal is formed between the waveguide and the first transducer, and a second acoustic seal is formed between the waveguide and the second transducer such that the first radiating surface of the second transducer is acoustically isolated from the acoustic volume. A third acoustic seal is formed between the waveguide and the cabinet such that the waveguide and the cabinet together at least partially define a sealed acoustic volume within which the coaxial transducer assembly is disposed, and a fourth acoustic seal is formed between the waveguide and the third transducer such that the first radiating surface of the third transducer is acoustically isolated from the first radiating surface of the second transducer.

In some examples, the first transducer is a tweeter, the second transducer is a woofer, and the third transducer is a mid-range transducer.

In certain examples, a shape of the waveguide controls a radiation pattern of acoustic energy radiated through the waveguide from the first transducer, a positioning of the first plurality of apertures in the waveguide control a radiation pattern of acoustic energy radiated through the first plurality of apertures from the first radiating surface of the second transducer, and a positioning of the second plurality of apertures in the waveguide control a radiation pattern of acoustic energy radiated through the second plurality of apertures from the first radiating surface of the third transducer.

In some implementations, the loudspeaker includes an acoustically transparent grill, and the waveguide includes a mouth and a raised region at a periphery of the mouth that is configured to support the acoustically transparent grille.

In another aspect, a loudspeaker includes a cabinet, a coaxial transducer assembly that is supported in the cabinet, and waveguide that is coupled to the cabinet such that the waveguide and the cabinet together at least partially define a sealed acoustic volume within which the coaxial transducer assembly is disposed. The coaxial transducer assembly includes a first transducer, and a second transducer that is coupled to the first transducer and arranged such that respective motion axes of the first and second transducers are coaxial. The waveguide is coupled to the first transducer and configured to provide an acoustic impedance match between the first transducer and free air. The waveguide includes a plurality of apertures than enables acoustic energy radiated from a first radiating surface of the second transducer to pass through the waveguide and merge with acoustic energy radiated by the first transducer. A shape of the waveguide controls a radiation pattern of acoustic energy radiated from the first transducer. A location of the apertures in the waveguide control a radiation pattern of acoustic energy radiated from the second transducer.

Implementations may include one of the above and/or below features, or any combination thereof.

In yet another aspect, a loudspeaker includes a cabinet, one or more transducers supported by the cabinet, and a plurality of pole mounts supported by the cabinet. The loudspeaker is configured to have a first radiation pattern in a first axial direction and a second radiation pattern, wider than the first radiation pattern, in a second axial direction orthogonal to the first axial direction. A first pole mount is supported on a first surface of the cabinet and configured to allow the loudspeaker to be mounted to a vertically oriented pole such that the second radiation pattern is arranged in a horizontal orientation. A second pole mount supported on a second surface of the cabinet adjacent to the first surface and configured to allow the loudspeaker to be mounted to the vertically oriented pole such that the second radiation pattern is arranged in a first vertical orientation. A third pole mount support on a third surface of the cabinet opposite the second surface and configured to allow the loudspeaker to be mounted to the vertically oriented pole such that the second radiation pattern is arranged in a second vertical orientation.

Implementations may include one of the above and/or below features, or any combination thereof.

In some implementations, the second radiation pattern is axially symmetric.

Implementations may include one or more of the following benefits, or any combination thereof.

Some implementations provide a more efficient use of volume of cabinet by sealing internal acoustic volume with waveguide, allowing better low frequency extensions with smaller overall dimensions than traditional loudspeaker construction methods. Certain implementations allow for the largest waveguide size possible for an outer dimension of the cabinet, only limited by size of cabinet, allowing venting of energy from cone(s) of LF/MF transducers through the waveguide so the waveguide can take up entire surface area of the front of the loudspeaker. In some implementations, beamwidth control is extended beyond the high frequency passband by using vent hole location to manipulate pattern in the axis. The vent hole locations can shape the low frequency beamwidth based on their location so different patterns are possible for the vertical and horizontal axis allowing for a smooth transition from low to high passbands resulting in consistent frequency response in the coverage pattern.

DETAILED DESCRIPTION

This disclosure relates to a multi-passband pattern control waveguide that merges the benefits of both the conventional two-way and the coaxial two-way design. A large waveguide is mounted to a high-frequency transducer of a coaxial transducer assembly allowing for optimum pattern control of the passband, while also sealing an internal cabinet acoustic volume so that additional acoustic volume is gained which gives a low-frequency driver of the coaxial transducer assembly the maximum volume possible from the outer dimensions of the cabinet. Low-frequency energy radiated by the low-frequency transducer is vented through apertures formed in the waveguide. While the shape of the waveguide dictates the high-frequency pattern, the location of the apertures in the waveguide determine the beamwidth of the low passband allowing the desired pattern of the loudspeaker to be extended below a high-frequency crossover point and into a low-frequency passband. The pattern of apertures in the waveguide in the horizontal and vertical axis can be modified to achieve different patterns in each axis if desired. The loudspeaker described herein may also employ a Helmholtz resonator that can be built into the waveguide or attached to the waveguide to dampen the effects of the acoustic bandpass created by sealing the waveguide to the front of the low-frequency transducer.

Figure 1:
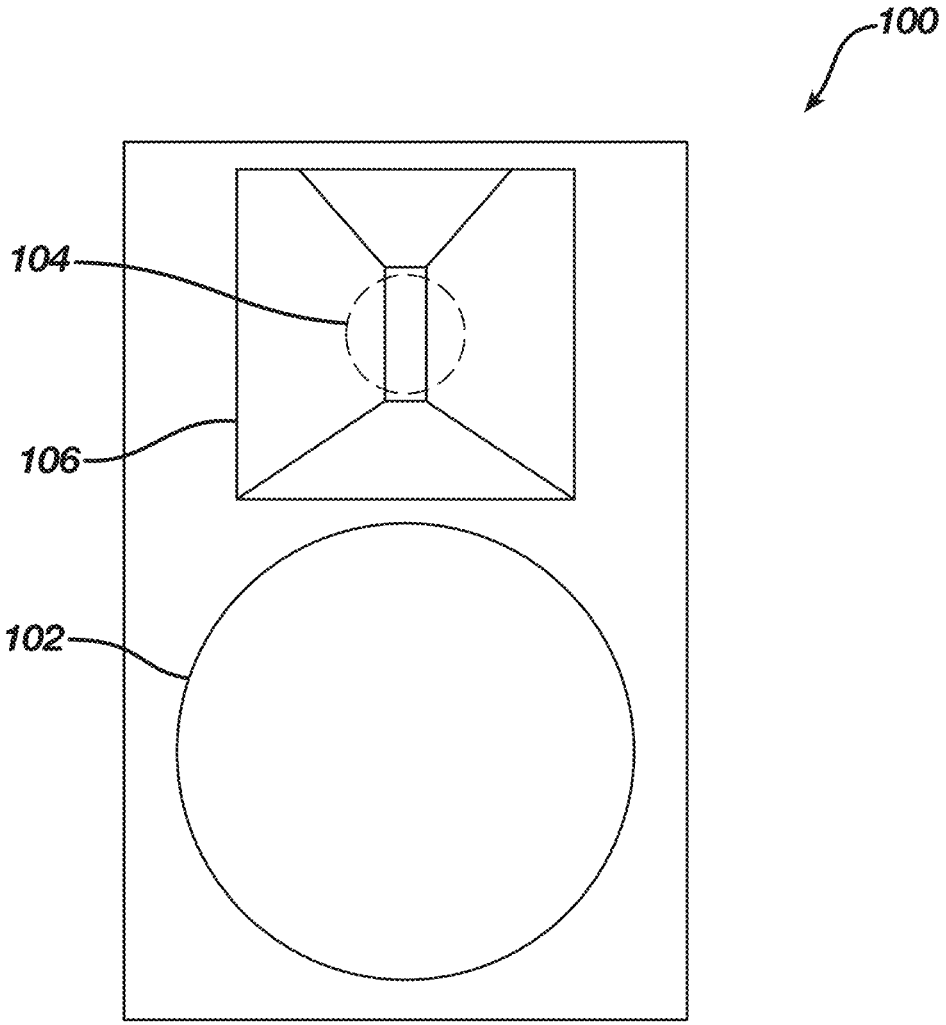
FIG. 1 is a front view of conventional two-way loudspeaker.
Figure 2:
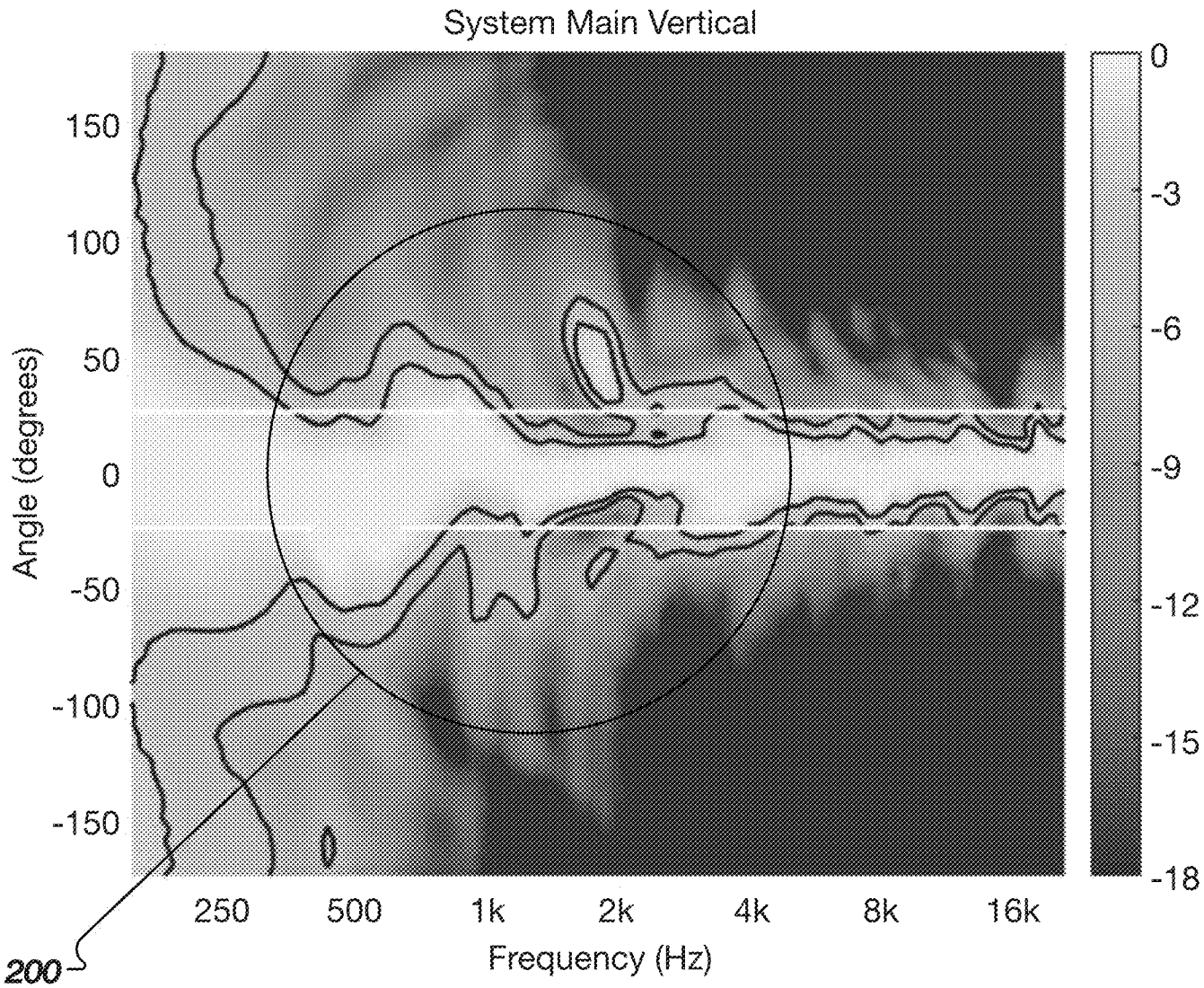
FIG. 2 is a vertical polar surface plot of a conventional two-way loudspeaker.
Figure 3A:
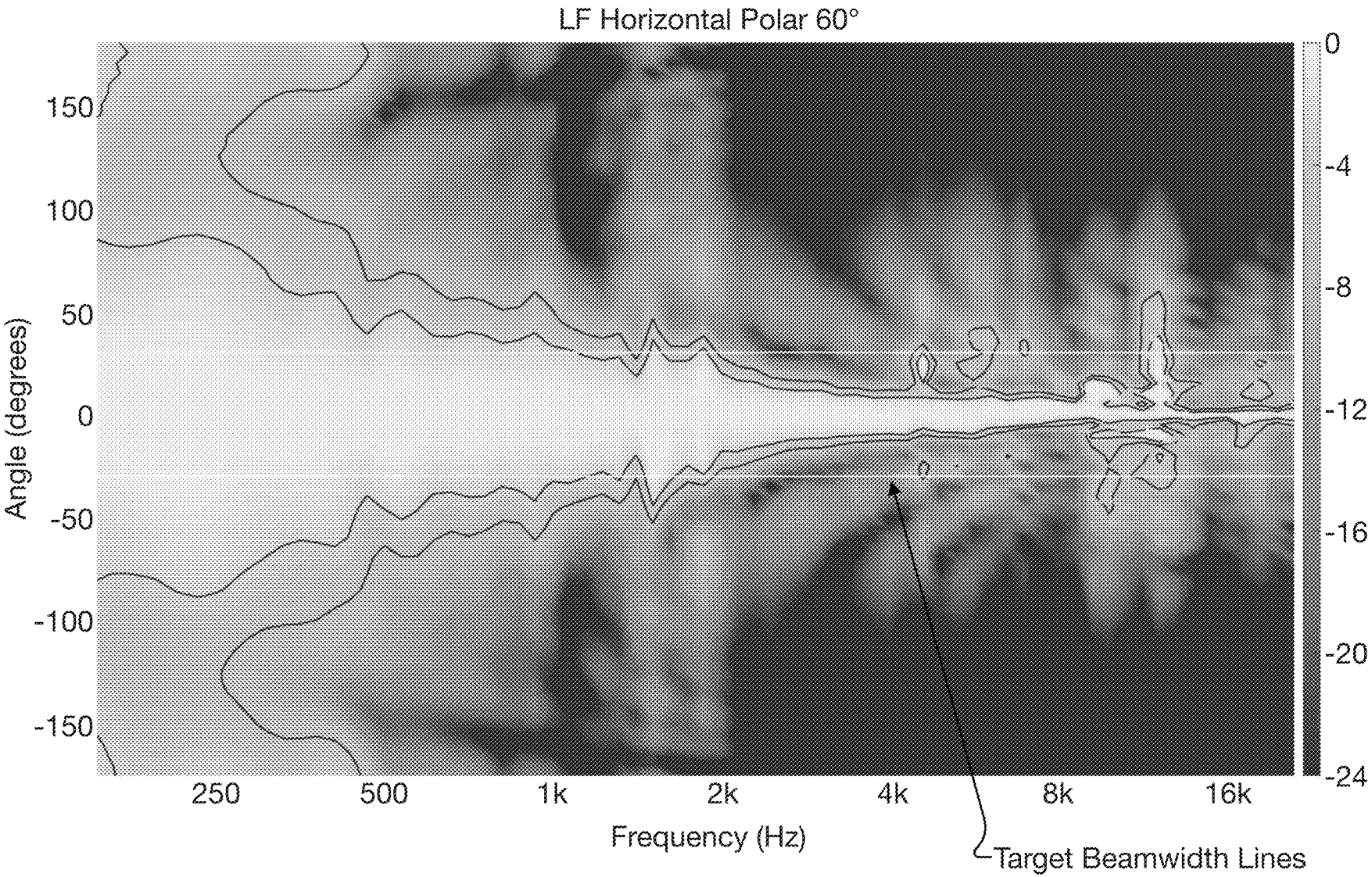
FIGS. 3A & 3B are horizontal polar surface plots for LF transducer and HF transducer, respectively, for a two-way loudspeaker with coaxially arranged transducers and a small waveguide.
Figure 3B:
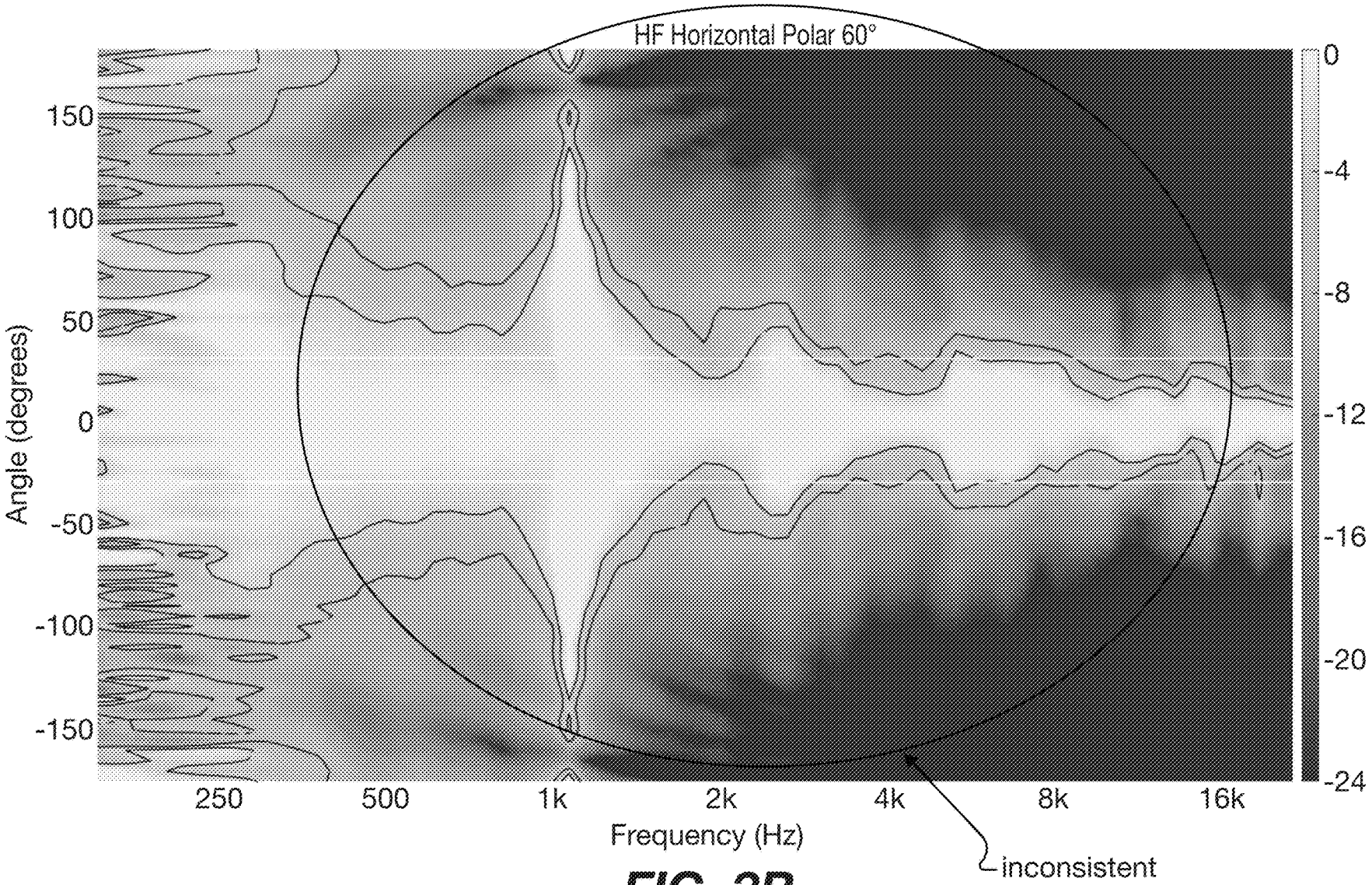
Figure 4A:
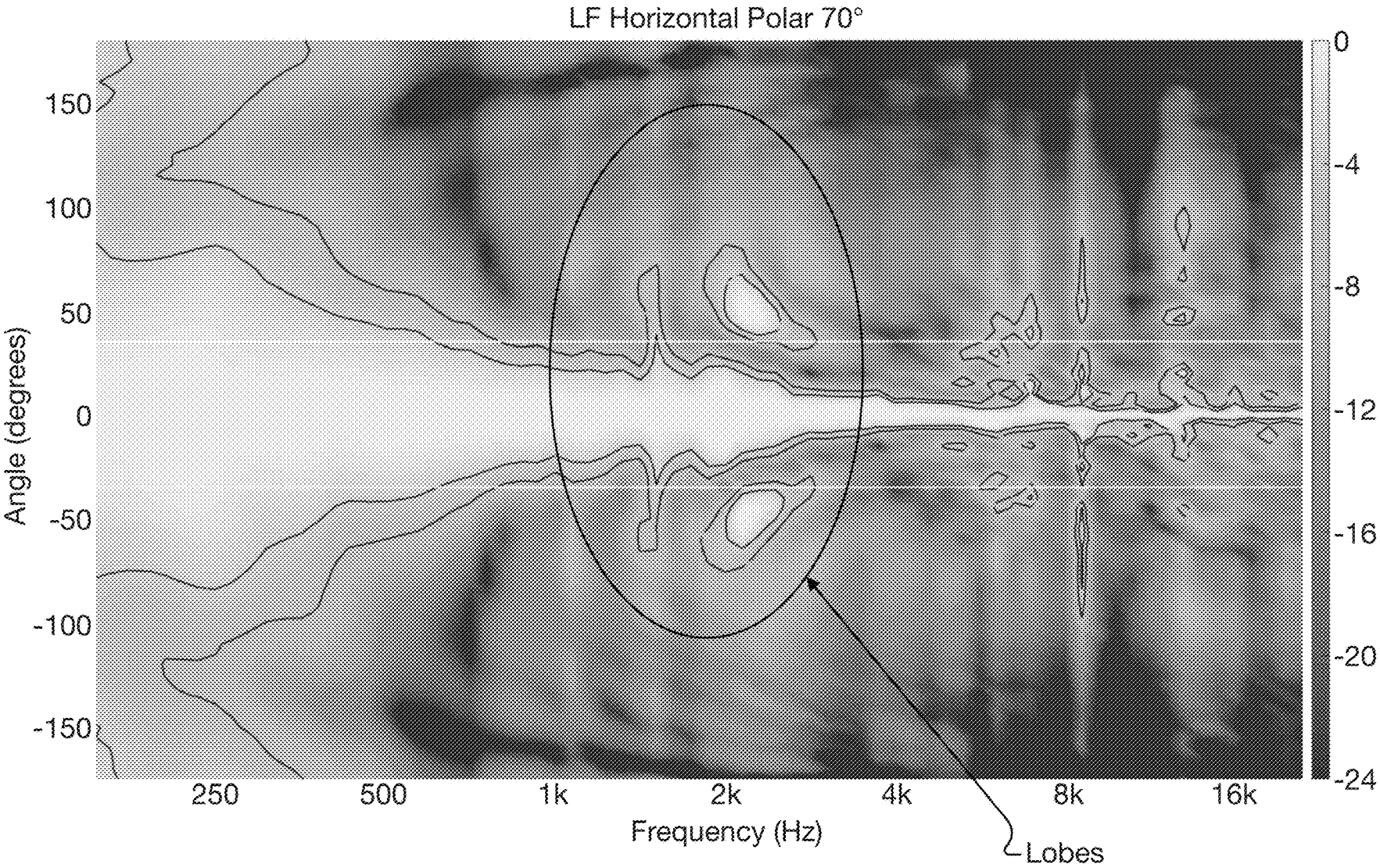
FIGS. 4A & 4B are horizontal polar plots for LF transducer and HF transducer, respectively, for a two-way loudspeaker with coaxially arranged transducers and a large waveguide.
Figure 4B:
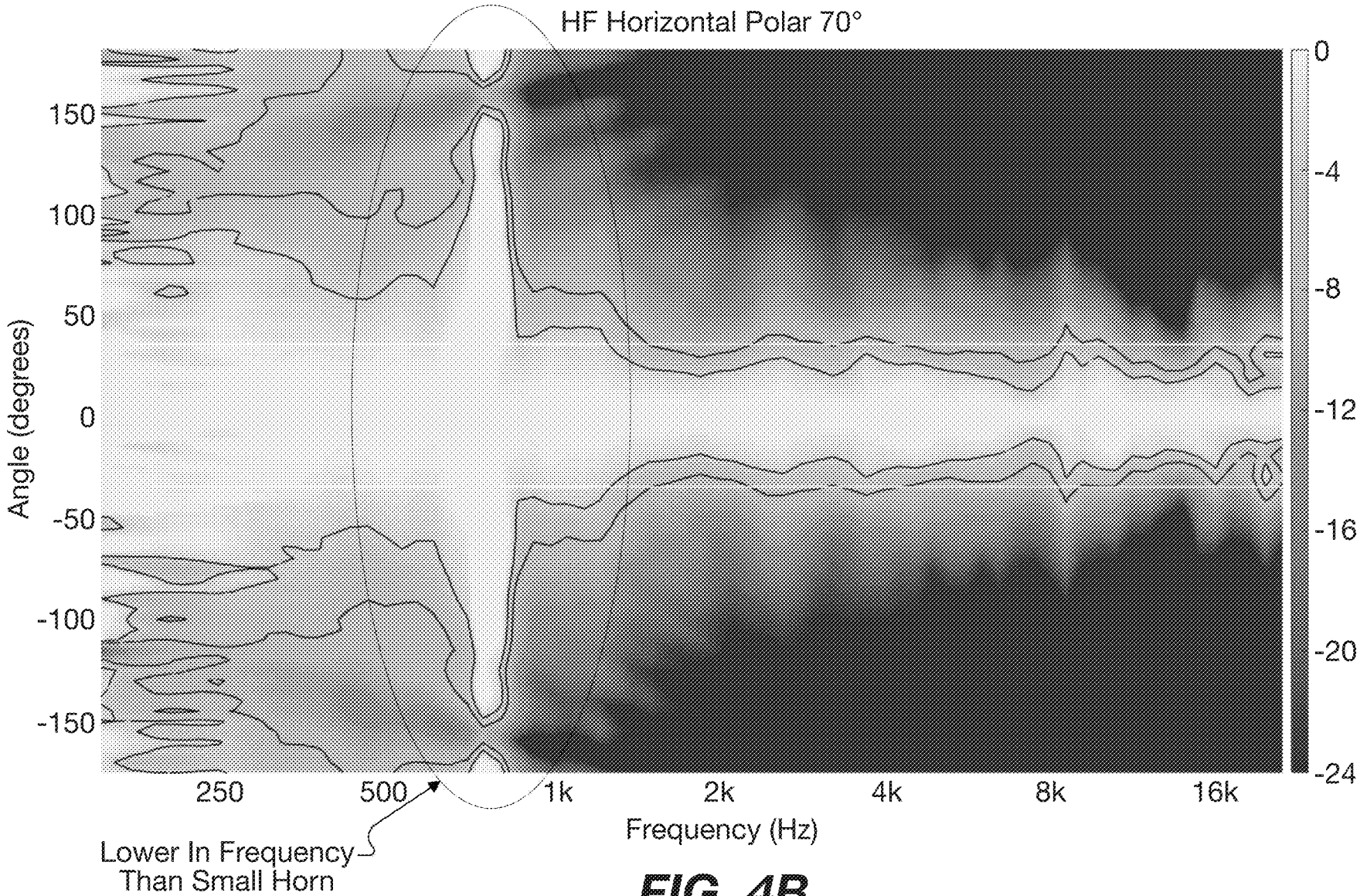
Figure 5A:
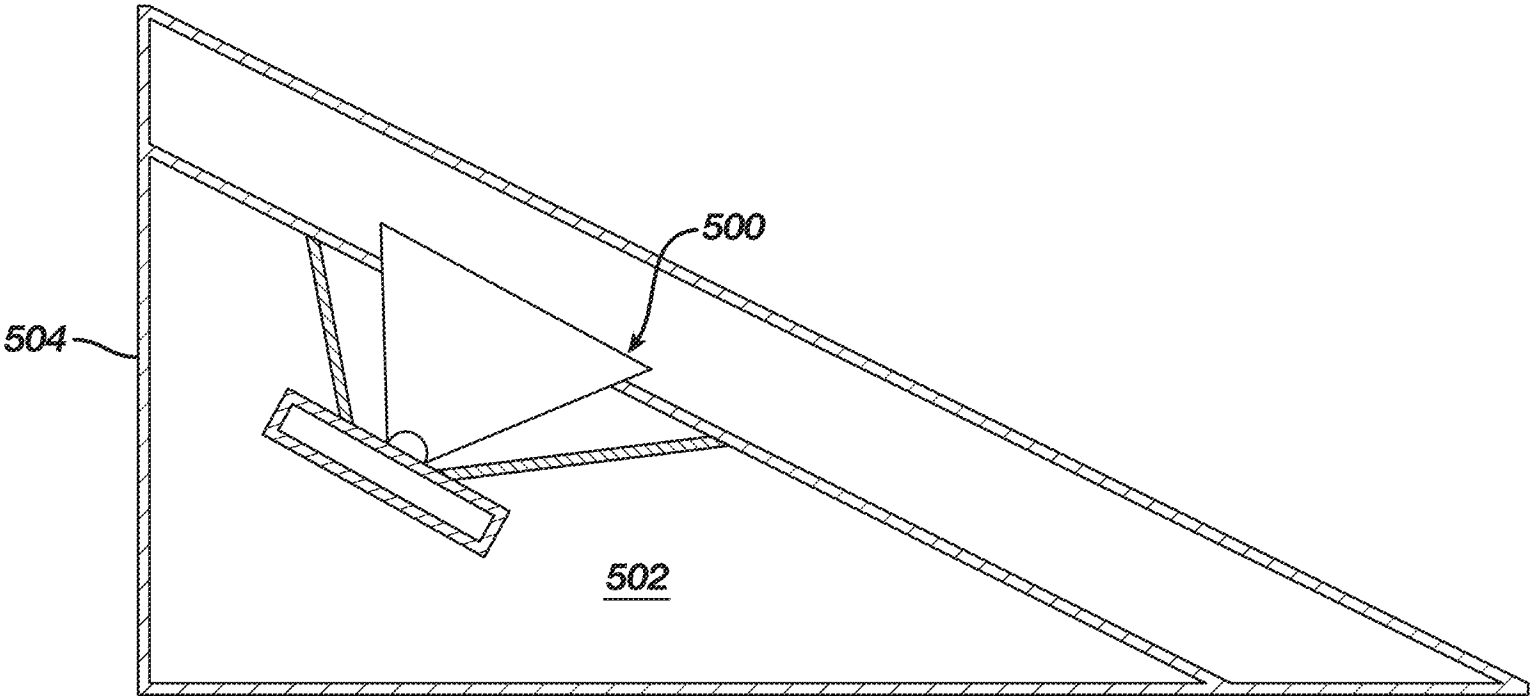
FIG. 5A is a cross-sectional side view of two-way loudspeaker with coaxially arranged transducers and a small waveguide.
Figure 5B:
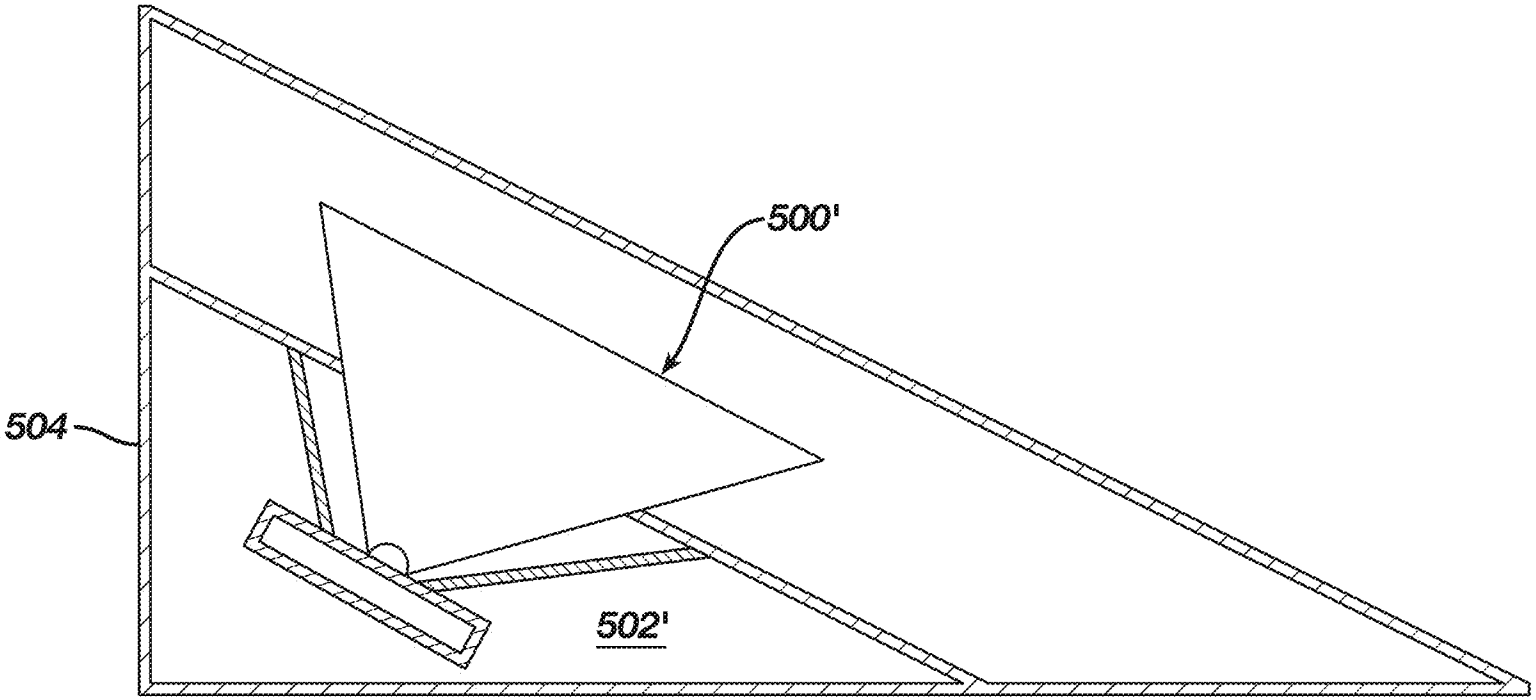
FIG. 5B is a cross-sectional side view of two-way loudspeaker with coaxially arranged transducers and a large waveguide.
Figure 6A:
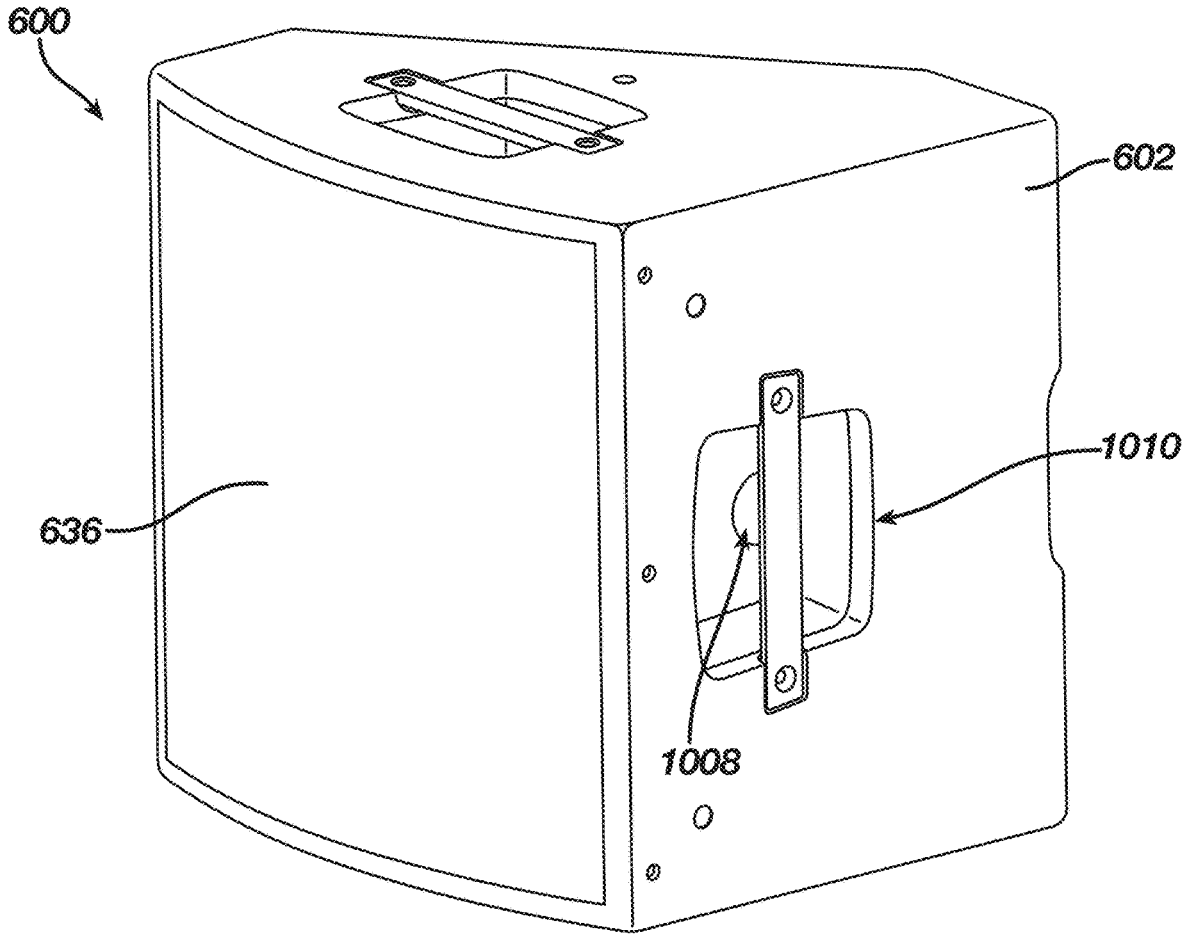
FIG. 6A is a perspective front view of a two-way loudspeaker with coaxially arranged transducers and a multi-passband pattern control waveguide.
Figure 6B:
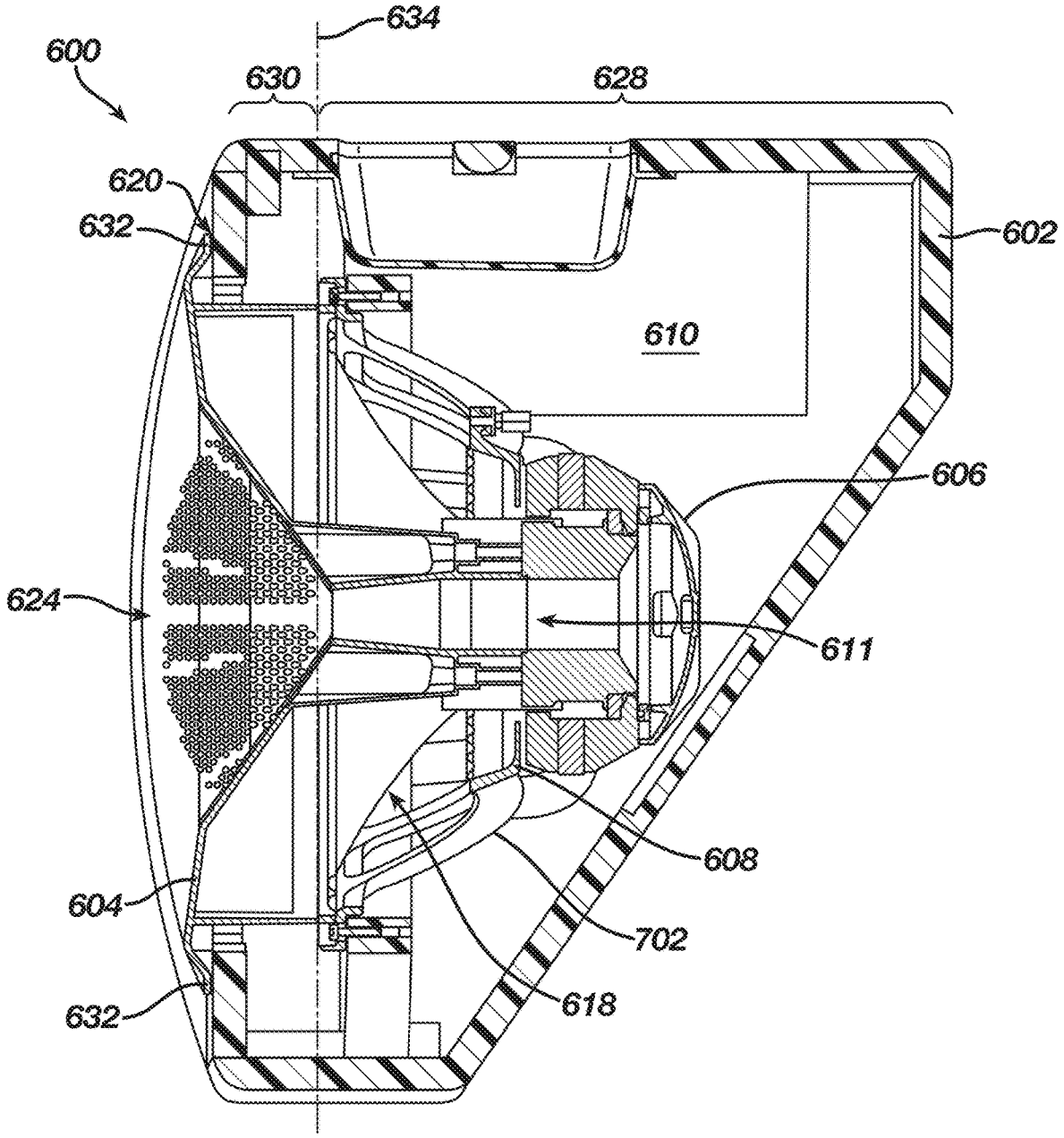
FIG. 6B is a cross-sectional side view of the loudspeaker of FIG. 6A (shown without grille).

Referring to FIGS. 6A & 6B (front perspective and cross-sectional side view), a loudspeaker 600 includes a cabinet 602 that, together with a waveguide 604 and a coaxial transducer assembly, defines an enclosed acoustic volume 610. The coaxial transducer assembly includes a coaxially arranged pair of transducers including a high-frequency transducer 606 (hereinafter "HF transducer") and a low-frequency transducer 608 (hereinafter "LF transducer"). The HF transducer 606 is disposed at a first open end 611 (a/k/a "throat") of the waveguide 604 and is configured to radiate acoustic energy into the waveguide through the first open end 611. In some cases, the HF transducer 606 includes a tweeter, such as a dome tweeter, cone tweeter, piezo tweeter, etc. Tweeters typically reproduces sound in the frequency range from 2,000 Hz to 20,000 Hz. In certain cases, the HF transducer 606 includes a compression driver. The LF transducer 608 is arranged coaxially with the HF transducer 606. In some cases, the LF transducer 608 is a woofer. Woofers typically reproduce sound in the frequency range from 40 Hz to 2000 Hz, e.g., 40 Hz to 500 Hz.

Figure 7A:
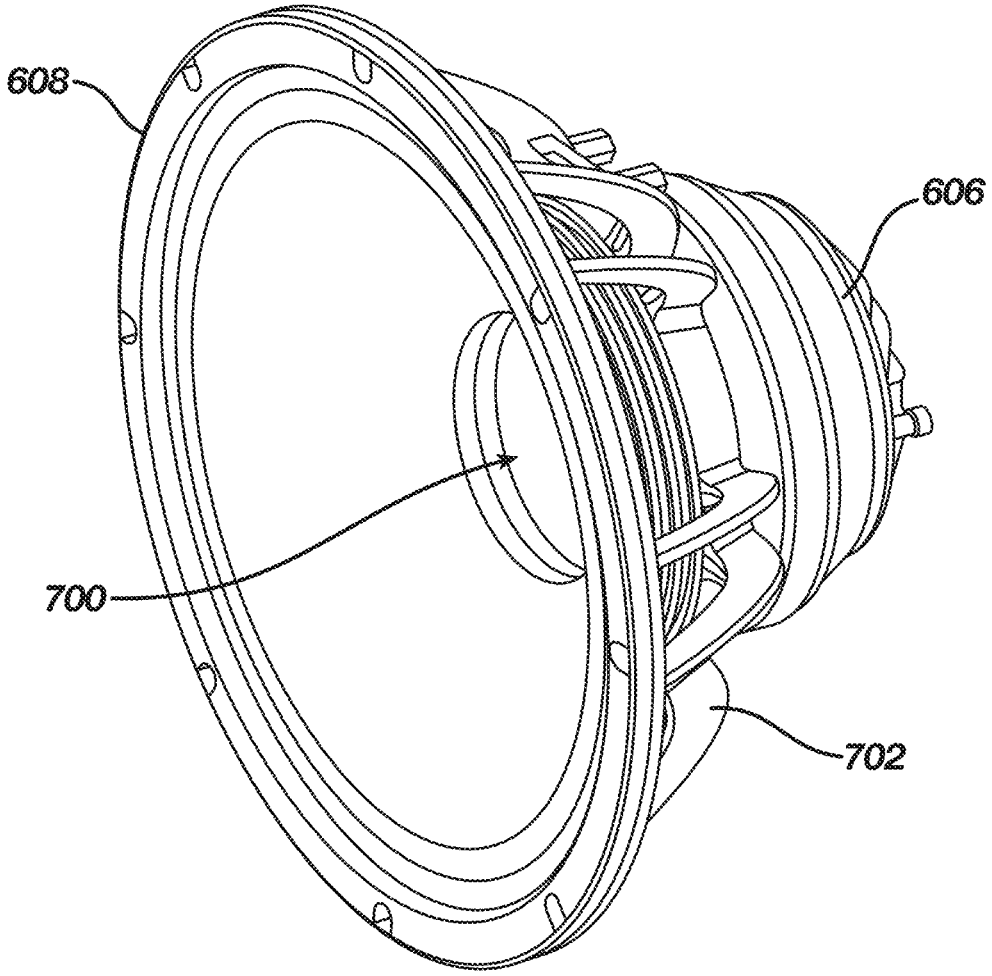
FIGS. 7A & 7B are front and rear perspective views, respectively, of a coaxial transducer assembly from the loudspeaker of FIG. 6.
Figure 7B:
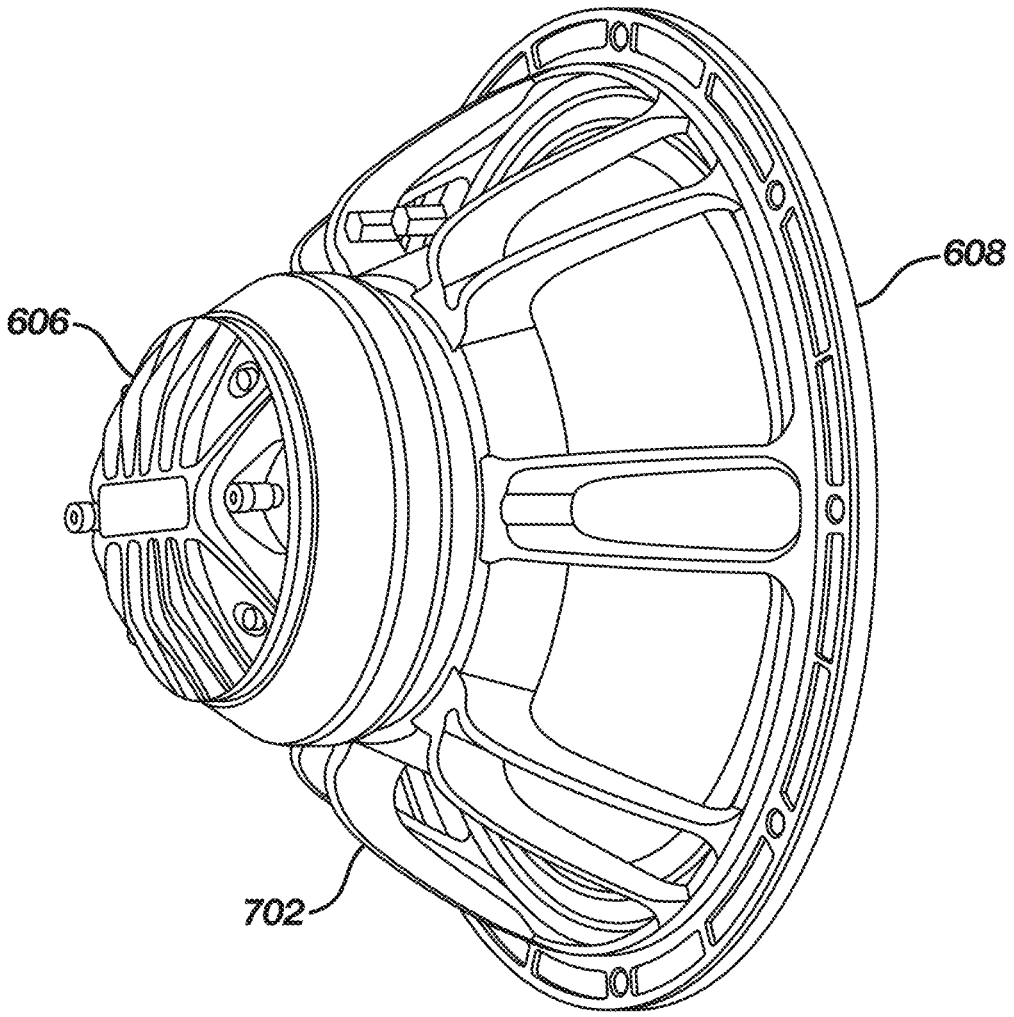

Referring to FIGS. 7A & 7B, the HF transducer 606 is arranged at the rear of the LF transducer 608 and is configured to fire (i.e., radiate acoustic energy) through an opening 700 in the center of the LF transducer 608. The HF transducer 606 is mechanically coupled to a basket 702 (a/k/a "frame") of the LF transducer 608, e.g., via fasteners such as screws.

Figure 8:
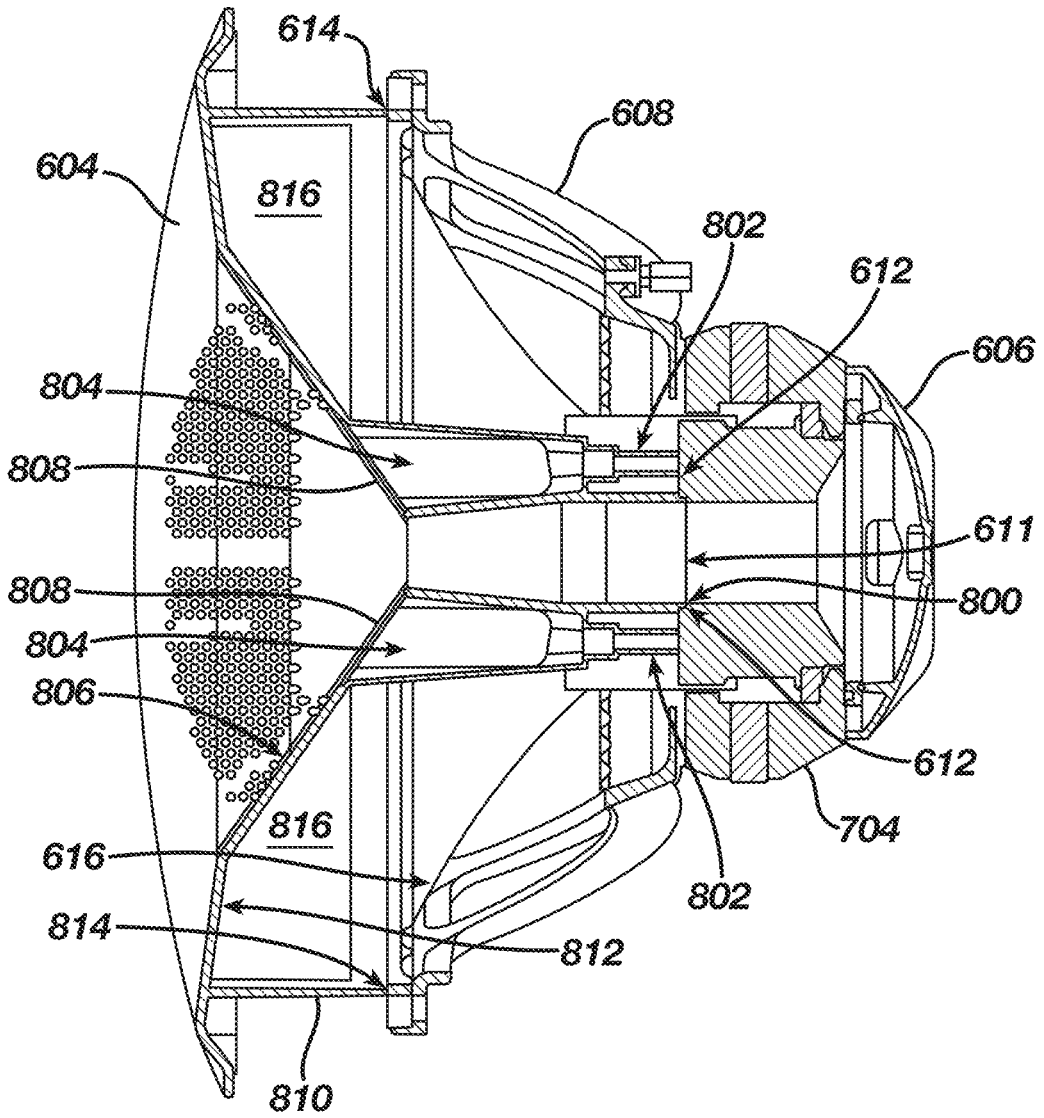
FIG. 8 is a cross-sectional side view of the coaxial transducer assembly of FIGS. 7A & 7B shown coupled to a waveguide.

With reference to FIG. 8, a first acoustic seal 612 is provided between the HF transducer 606 and the first open end 611 of the waveguide 604 such that acoustic energy radiated from the LF transducer 608 is unable to enter the waveguide 604 via the first open end 611. The waveguide 604 provides an acoustic load (a/k/a "horn loading") on the HF transducer 606 to provide an acoustic impedance match between the HF transducer 606 and free air. In some cases, a housing 704 of the HF transducer 606 may be provided with a recess 706 for receiving the first open end 611 of the waveguide 604 to assist in forming the first acoustic seal 612. In that regard, the recess 706 may receive a lip 800 formed at the first open end 611 of the waveguide 604. In some cases, gasket material may be disposed between the first open end 611 of the waveguide 604 and the housing 704 of the HF transducer 606 to help provide the first acoustic seal 612.

A pair of mounting posts 802 are provided at the first open end 611 of the waveguide 604 and are arranged to accommodate fasteners, installed via the front of the waveguide 604, for engaging the housing 704, and, thus, securing the HF transducer 606 to the waveguide 604. The fasteners are installed through though holes 804 formed in the waveguide 604. The through holes 804 pass through the center of the mounting posts 802. Open ends of the through holes 804 are provided in the front surface 806 of the waveguide 604 for receiving the fasteners, and, thereby, enabling assembly. Those open ends are covered with caps 808, which, when installed, help to define the acoustic geometry of the waveguide 604.

A second acoustic seal 614 is provided between a front radiating surface 616 of the LF transducer 608 and a rear surface 618 of the waveguide 604 such that acoustic energy radiated from the front radiating surface 616 of the LF transducer 608 is unable to enter the acoustic volume 610 (FIG. 6B). The rear radiating surface 618 of the LF transducer 608 radiates acoustic energy into the acoustic volume 610. A wall 810 extends outwardly from a rear surface 812 of the waveguide 604 and terminates at a free end 814.

Since the LF transducer 608 and the HF transducer 606 are mechanically coupled together, the coupling of the HF transducer 606 to the waveguide 604, via the mounting posts 802, helps to ensure that the LF transducer 608 is tightly coupled to the free end 814 of the wall 810 to form the second acoustic seal 614; i.e., the fastening of the HF transducer 606 to the waveguide 604 helps to pull the LF transducer 608 into close contact with the free end 814 of the wall 810. In other cases, the LF transducer 608 and the HF transducer 606 may each be separately coupled to the waveguide 604, e.g., via fasteners, and may be coupled together via the waveguide 604.

The wall 810 helps to define an acoustic channel 816 between the front radiating surface 616 of the LF transducer 608 and the rear surface 812 of the waveguide 604; the acoustic channel 622 being acoustically isolated from the internal cabinet acoustic volume 610. In some cases, the wall 810 may be a cylindrical wall with a circular cross-sectional area. In other cases, the wall may include a plurality of walls that extend outwardly from the rear surface of the waveguide to define a cross-sectional area in the shape of a closed polygon. The wall 810 may be formed integrally with the waveguide 604 as a unitary molded plastic part.

Referring again to FIG. 6B, a third acoustic seal 620 is provided between the waveguide 604 and the cabinet 602, such that acoustic energy radiated from the rear radiating surface 618 of the LF transducer 608 is retained in the acoustic volume 610. The third acoustic seal 620 is formed by securing a second open end 624 (a/k/a "mouth") of the waveguide 604 to the cabinet 602. In that regard, peripheral edges 632, near the second open end 624, of the waveguide 604 may be secured to the cabinet 602 using fasteners. The third acoustic seal 620 acoustically isolates the acoustic volume 610 inside the cabinet 602 from environment outside of and surrounding the cabinet 602. In some cases, a gasket may be disposed between the waveguide 604 and the cabinet 602 to help ensure that the cabinet is acoustically sealed. Notably, the third acoustic seal 620 is formed forward of the basket 702 of the LF transducer 608 enabling the acoustic volume 610 to extend into the region in front of LF transducer 608. The acoustic volume 610 including a first region 628 and a second region 630. The first region 628 extending rearward of the LF transducer 608 and such that the rear radiating surface 618 of the LF transducer 608 radiates acoustic energy into the first region 628. The LF transducer 608 is completely disposed within the first region 628 such that no portion of the LF transducer 608 extends into the second region 630. The second region 630 is positioned forward of the front radiating surface 616 of the LF transducer 608. The first region 628 and the second region 630 being separable by a plane 634 that extends perpendicular to the motion axes of the transducers. In some cases, the second region 630 accounts for at least 10% of the total volume of the acoustic volume 610. For example, the second region may account for at least 25% of the total volume of the acoustic volume 610, e.g., at least 50%. In certain examples, the second region 630 accounts for more than 50% of the total volume of the acoustic volume 610.

Figure 9:
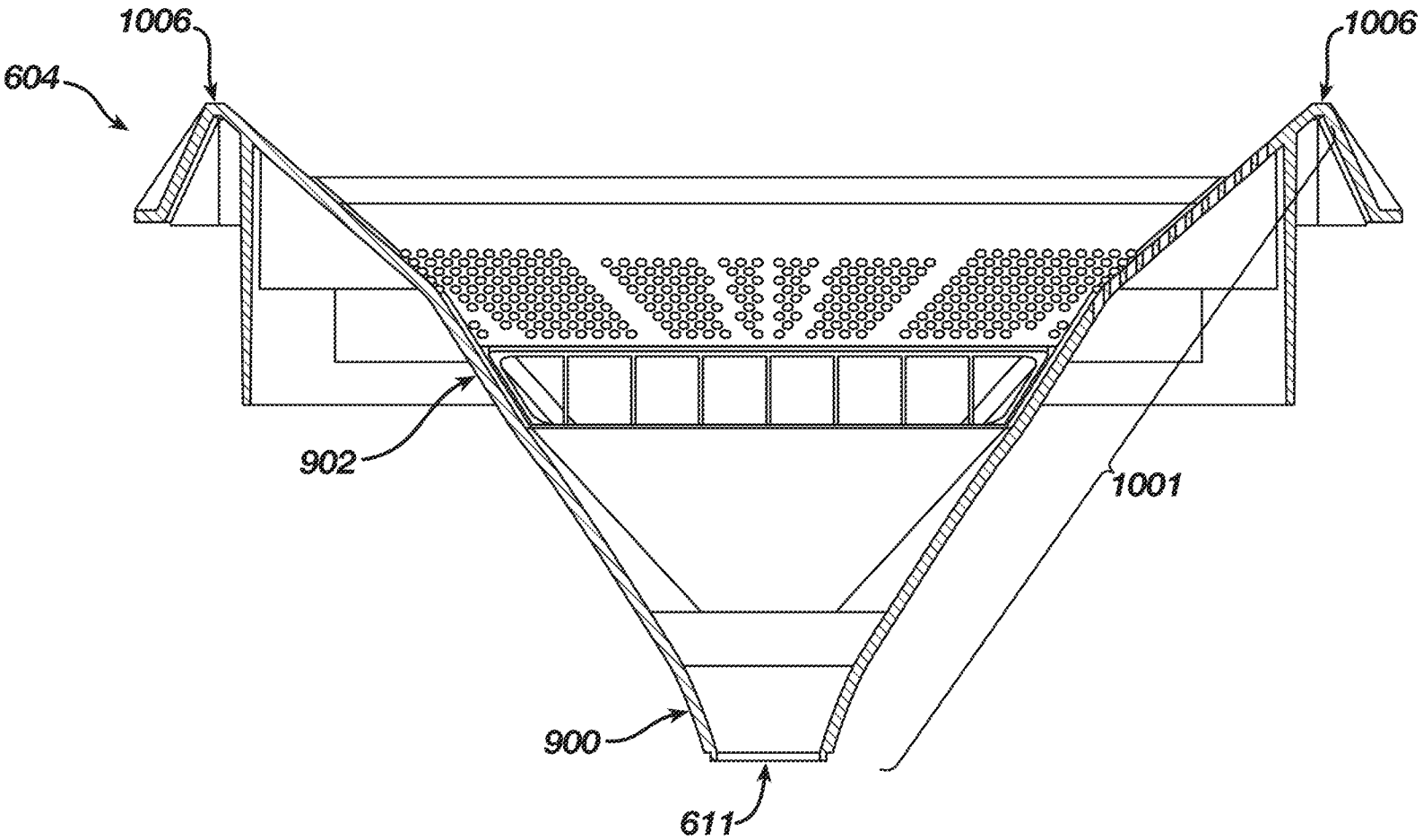
FIG. 9 is a cross-sectional top view of the waveguide of FIGS. 8A & 8B.

Referring to FIG. 9, the waveguide 604 has a hybrid horn geometry with an exponential section 900, having an exponential expansion rate, near the first open end 611 and a conical section 902, having a conical expansion rate, near the second open end 624 of the waveguide 604. In other implementations, the waveguide may have an alternative expansion rate geometry or geometries. For example, the waveguide may have simple conical geometry that extends from throat to mouth, or an exponential expansion rate that extends from throat to mouth. Alternatively, in some implementations, the waveguide may have a bi-radial geometry or a tractrix geometry.

Figure 10A:
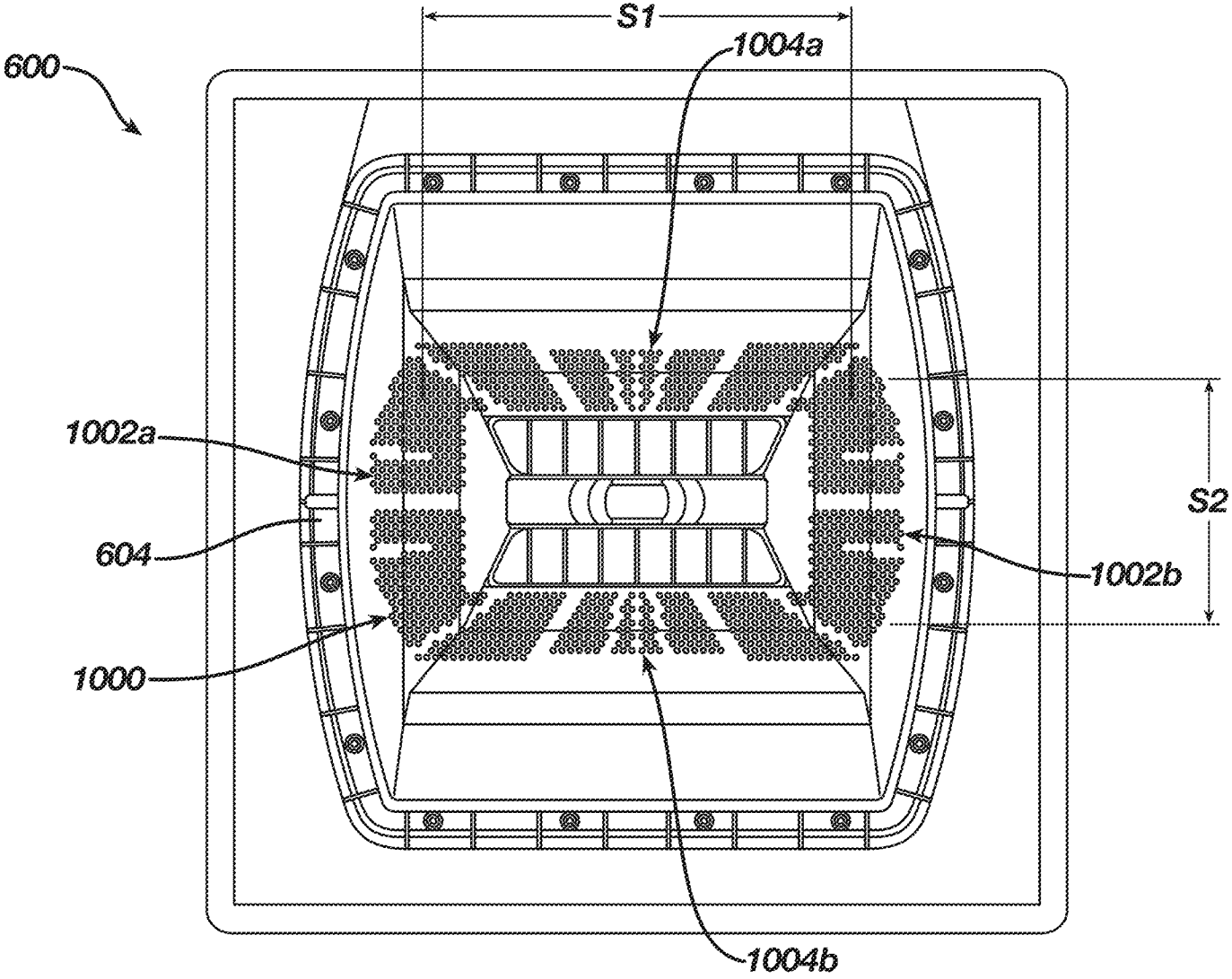
FIG. 10A is a front view of the loudspeaker of FIG. 6A with its grille removed.

With reference to FIG. 10A, a front view of loudspeaker 600 (with grille removed), a plurality of apertures 1000 provided in the waveguide 604 allow the acoustic energy radiated from the front radiating surface 616 (FIG. 8) of the LF transducer 608 to pass through the acoustic channel 816 (FIG. 8) and out through the front surface of the waveguide 604, where it merges with high-frequency energy radiated from the HF transducer 606 (FIG. 8). The apertures 1000 extend through the front surface of the waveguide and in a region of the waveguide 604 that assists in shaping the radiation pattern of acoustic energy radiated the HF transducer 606. The apertures 1000 are located in the expansion region 1001 (FIG. 9) of the waveguide 606. The expansion region 1001 being a tapered and/or curved region of the waveguide 604 that controls the shape of the radiation pattern of the acoustic energy radiated from the HF transducer 606. In the illustrated example, the expansion region 1001 includes both the exponential section 902 and the conical section 902. And, in the illustrated example, the apertures 1000 extend through the conical section 902. Notably, the LF transducer 608 operates below the low-frequency cutoff of the waveguide 604, such that there is no horn loading on the LF transducer 608. Rather, the waveguide 604 is acoustically transparent to the LF transducer 608. The waveguide 604 allows for pattern control of the passband, while also sealing the internal cabinet acoustic volume 610 (FIG. 6B) so the volume above the woofer basket 702 is gained which gives the LF transducer 608 the maximum volume possible from the outer dimensions of the cabinet 602 (FIG. 6B). The low frequency energy off the front radiating surface of the LF transducer 608 is vented through the apertures 1000 in the waveguide 604. While the shape of the waveguide 604 dictates the high frequency pattern, the location of the apertures 1000 in the waveguide 604 determine the beam width of the low passband allowing the desired pattern of the loudspeaker 600 to be extended below the high frequency crossover point and into the low frequency passband. The pattern of apertures 1000 in the waveguide in the horizontal and vertical axis can be modified to achieve different patterns in each axis if desired.

In the illustrated example, the plurality of apertures 1000 includes a first pair of aperture arrays (i.e., aperture array 1002*a* and aperture array 1002*b*) arranged along a first axis (x-axis) and a second pair of aperture arrays (i.e., aperture array 1004*a* and aperture array 1004*b*) arranged along a second axis (y-axis). The spacing S1 between the aperture arrays 1002*a*, 1002*b* of the first pair is greater than the spacing S2 between the aperture arrays 1004*a*, 1004*b* of the second pair, resulting in a narrower radiation pattern in the horizontal (x-axis) direction and a relatively wider radiation pattern in the vertical (y-axis) direction. The "spacing" refers to the distance between the centroids of the aperture arrays within a pair. In the illustrated example, the spacing S1 refers to the distance between the centroid of aperture array 1002*a* and the centroid of aperture array 1002*b*. Likewise, the spacing S2 refers to the distance between the centroid of aperture array 1004*a* and the centroid of aperture array 1004*b*. The individual apertures 1000 may have a diameter of between 3 mm and 25 mm (or the equivalent cross-sectional area to a round hole of that dimension). The total open surface area of the apertures can be important for controlling the Total Harmonic Distortion (THC). In some cases, the apertures have a total open surface area that enables the THD to be maintained below −20 dB. While the illustrated example includes symmetrically arranged aperture arrays, in some implementations, the waveguide may include asymmetrically arranged aperture arrays.

Figure 10B:
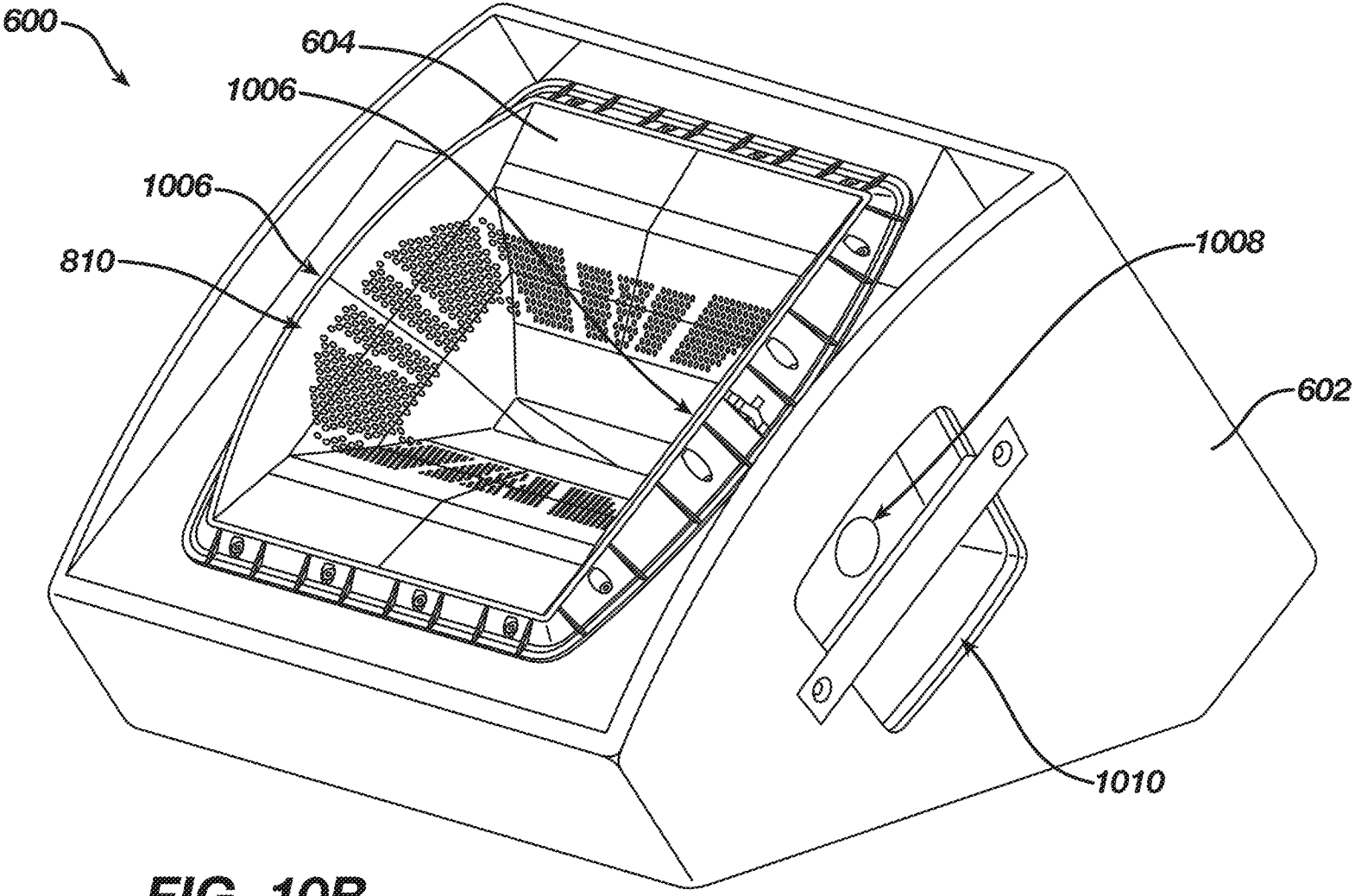
FIGS. 10B and 10C is perspective views, showing opposing sides, of the loudspeaker of FIG. 6A with its grille removed.

With reference to FIG. 10B, the waveguide 604 may define raised regions, e.g., raised edges 1006 (see also FIG. 9), along its second open end 810 to help support an acoustically transparent grille 636 (FIG. 6A). In some cases, the grille 636 completely covers the waveguide 604, such that it is not visible. In some cases, an acoustically transparent foam material may be disposed between the grille 624 and the waveguide 604. The foam material can help to inhibit (e.g., prevent) buzzing between the grille 636 and the waveguide 604. The foam material can also help to hide the waveguide 604.

Figure 10C:
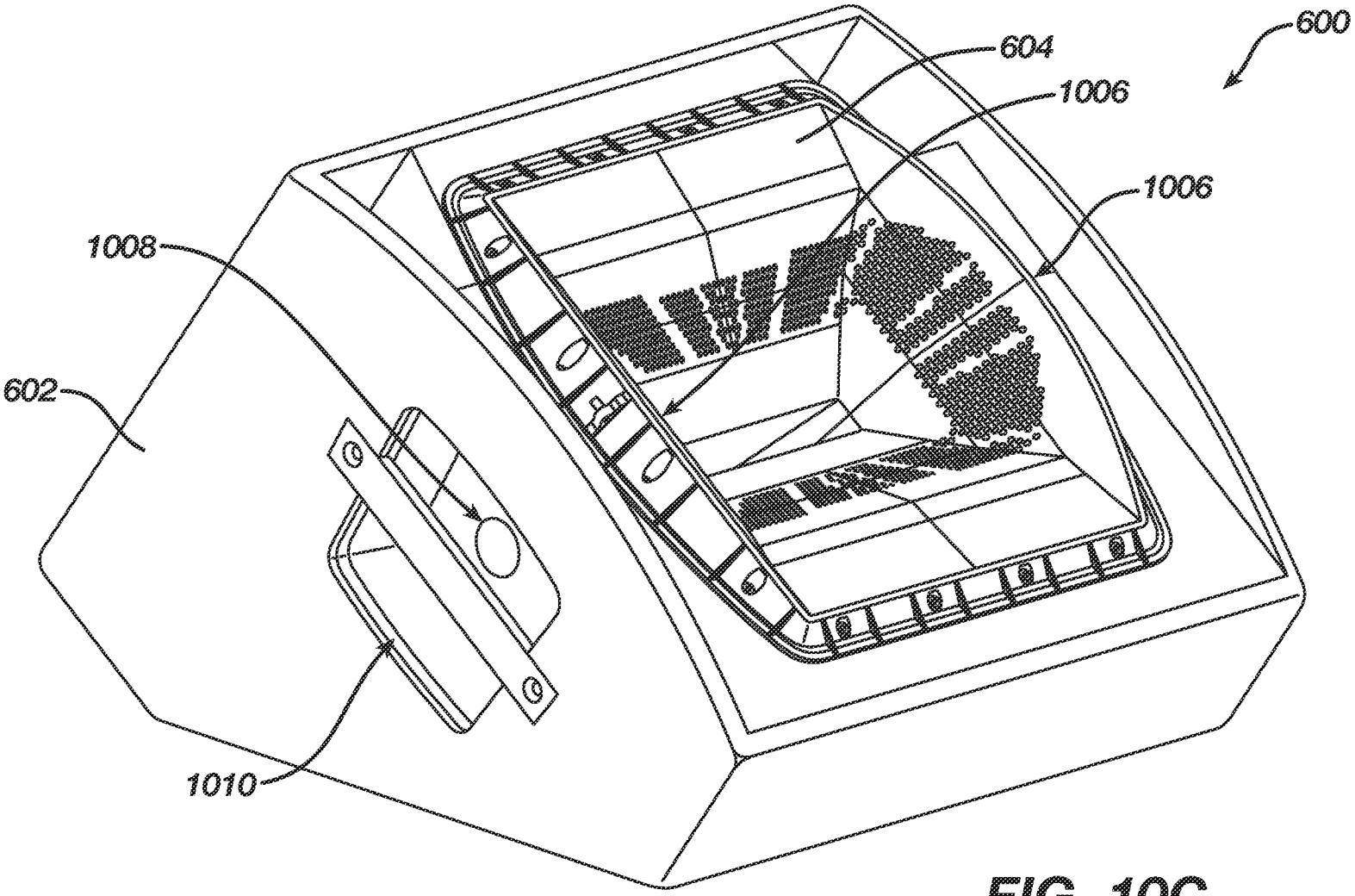

With reference to FIGS. 10B, 10C and 6A, the loudspeaker 600 is provided with a number of pole mounts 1008 which are configured to receive an end of a mounting pole. In some cases, one or more of the pole mounts 1008 may be configured to receive a threaded end of a mounting pole. The pole mounts 1008 are disposed within handle cups 1010 on various outer surfaces of the cabinet 602. The pole mounts 1008 are located on at least two adjacent side surfaces such that the wider radiation pattern of the waveguide 604 can be selectively arranged in a vertical or horizontal orientation when mounted on a pole, thereby allowing a user to select from a wide horizontal radiation pattern and a narrow horizontal radiation pattern by simply rotating the loudspeaker 600. In some cases, pole mounts 1008 may be disposed on opposite side surfaces of the cabinet 602 so that regardless of which direction the user rotates the loudspeaker when rotating from the wide horizontal orientation to the narrow horizontal orientation, there is always a pole mount 1008 on the surface of the cabinet 602 that faces downward towards a threaded end of a mounting pole.

Other Embodiments

Figure 11:
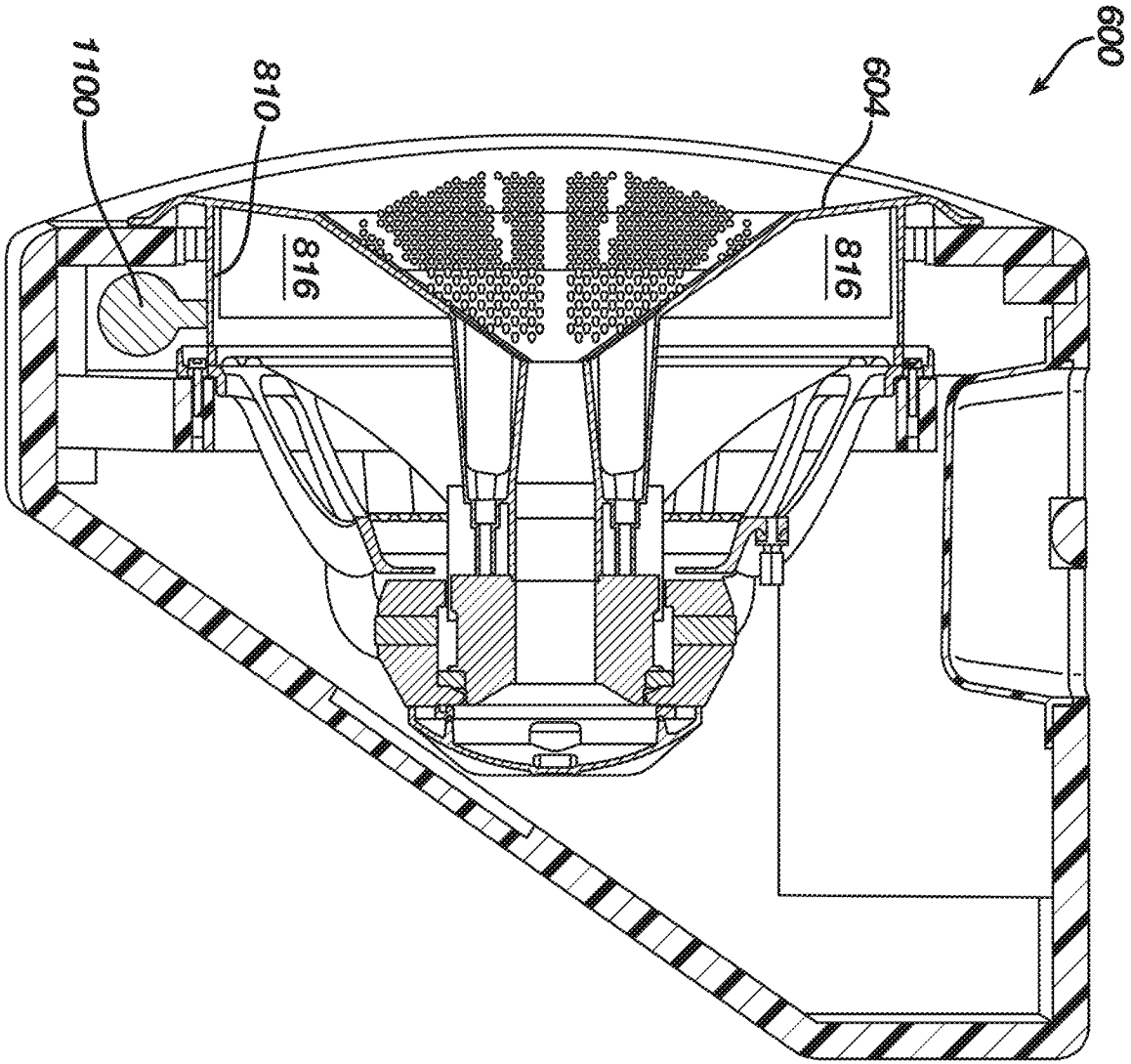
FIG. 11 is cross sectional side view of two-way loudspeaker with a multi-passband pattern control waveguide including a Helmholtz resonator.

As shown in FIG. 11, in some implementations, the loudspeaker 600 may include a Helmholtz resonator 1100 that can be built into the waveguide or attached to the waveguide to dampen the effects of the acoustic bandpass created by sealing the waveguide to the front of the LF transducer 608. In the illustrated example, the Helmholtz resonator 1100 is acoustically coupled to the acoustic channel 816 via the wall 810. In other examples, the Helmholtz resonator could be couple through to the acoustic channel through the front of the waveguide. Alternatively or additionally, the Helmholtz resonator may take the form of a pocket that is inside the cavity in front of the woofer.

Figure 12A:
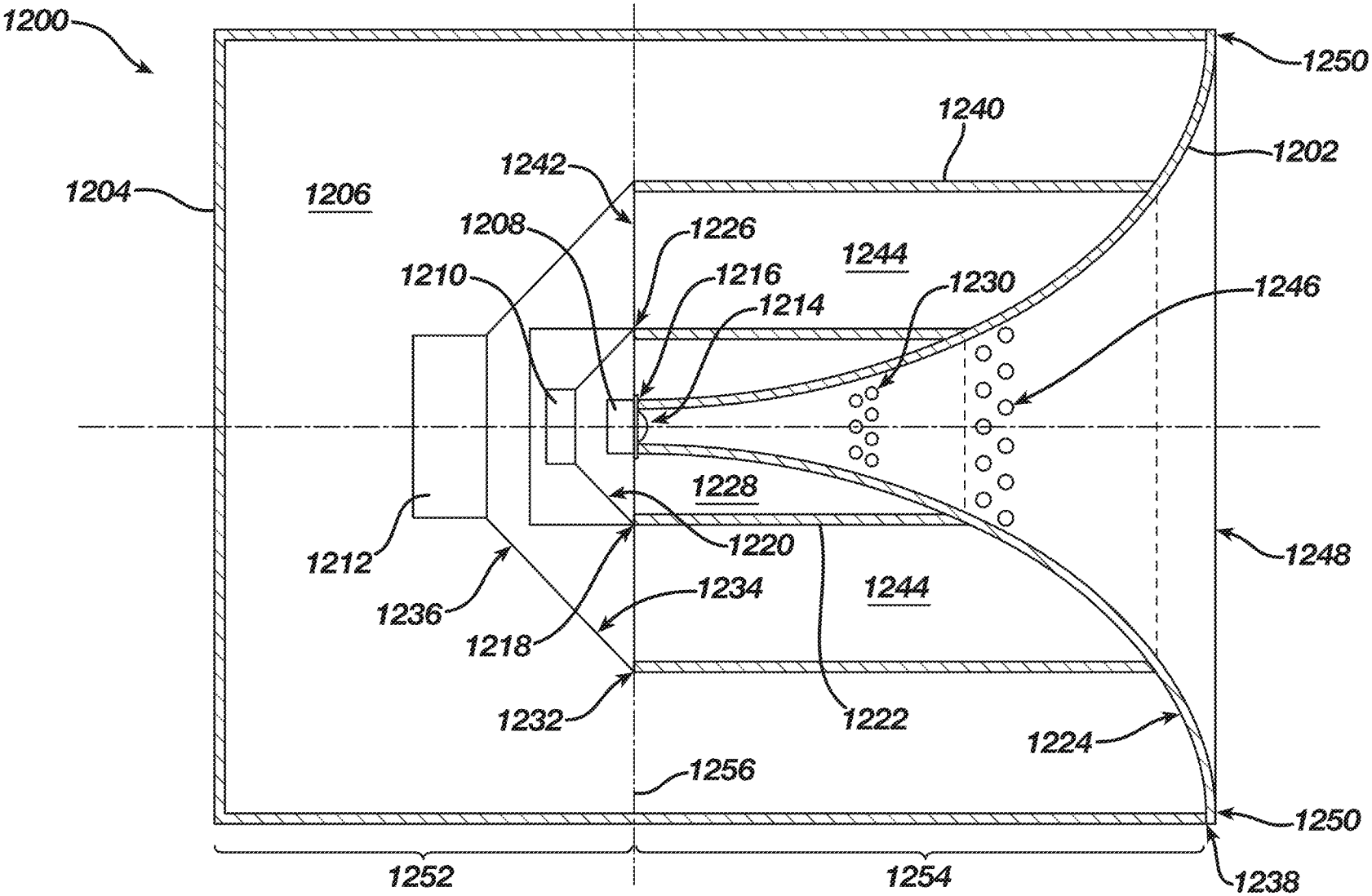
FIG. 12A is a cross-sectional side view of a multi-way (three-way) loudspeaker with three coaxially arranged loudspeakers and a multi-passband pattern control waveguide.

While a two-way loudspeaker has been described above, other multi-way loudspeakers are also contemplated. For example, FIG. 12A illustrates a three-way loudspeaker 1200 that employs a multi-passband pattern control waveguide 1202. The loudspeaker 1200 includes a cabinet 1204 that, together with the waveguide 1202 and a coaxial transducer assembly, defines an enclosed acoustic volume 1206. The coaxial transducer assembly includes a high-frequency transducer 1208 (hereinafter "HF transducer"), a mid-range or mid-frequency (MF) transducer 1210, and a low-frequency transducer 1212 (hereinafter "LF transducer"). The HF transducer 1208 is disposed at a first open end 1214 (a/k/a "throat") of the waveguide 1202 and is configured to radiate acoustic energy into the waveguide 1202 through the first open end 1214. In some cases, the HF transducer 1208 includes a tweeter, such as a dome tweeter, cone tweeter, piezo tweeter, etc. In certain implementations, the HF transducer 1208 reproduces sound in the frequency range from 2,000 Hz to 20,000 Hz.

The MF transducer 1210 is arranged coaxially with the HF transducer 1208 and such that the HF transducer 1208 is disposed between the first open end 1214 of the waveguide 1202 and the MF transducer 1210. The LF transducer 608 is arranged coaxially with the HF transducer 1208 and the MF transducer 1210 and such that the MF transducer 1210 is disposed between the HF transducer 1208 and the LF transducer 1212. In certain implementations, the LF transducer 1212 includes a woofer. In some implementations, the LF transducer 1212 reproduces sound in the frequency range from 40 Hz to 500 Hz. In some implementations, the MF transducer 1210 may have a sealed back to prevent acoustic energy radiated from a rear radiating surface of the MF transducer 1210 from radiating into the region between the MF transducer 1210 and the LF transducer 1212. Alternatively, the MF transducer 1210 may have an open back and a separate enclosure may be provided to acoustically isolate the rear radiating surface of the MF transducer 1210. In some examples, the MF transducer 1210 reproduces sound in the frequency range from 250 Hz to 2000 Hz.

A first acoustic seal 1216 is provided between the HF transducer 1208 and the first open end 1214 (a/k/a "throat") of the waveguide 1202 such that acoustic energy radiated from the MF transducer 1210 and the LF transducer 1212 is unable to enter the waveguide 1202 via the first open end 1214. The waveguide 1202 provides an acoustic load (a/k/a "horn loading") on the HF transducer 1208 to provide an acoustic impedance match between the HF transducer 1208 and free air.

A second acoustic seal 1218 is provided between a front radiating surface of the MF transducer 1210 and a rear surface of the waveguide 1202 such that acoustic energy radiated from the front radiating surface 1220 of the MF transducer 1210 is unable to enter the region between the MF transducer 1210 and the LF transducer 1212. A first wall 1222 extends outwardly from a rear surface 1224 of the waveguide 1202 and terminates at a free end 1226 that is coupled to the MF transducer 1210 so as to form the second acoustic seal 1218 therebetween. A gasket may be used between the mating surfaces of the MF transducer 1210 and the first wall 1222 to help provide the second acoustic seal 1218. The first wall 1222 helps to define a first acoustic channel 1228 that acoustically couples the front radiating surface of the MF transducer 1210 to a first set of apertures 1230 in the waveguide 1202. In some cases, the first wall may be a cylindrical wall with a circular cross-sectional area. In other cases, the at least one wall may include a plurality of walls that extend outwardly from the rear surface of the waveguide to define a cross-sectional area in the shape of a closed polygon.

A third acoustic seal 1232 is provided between a front radiating surface of the LF transducer 1212 and the rear surface of the waveguide 1202 such that acoustic energy radiated from the front radiating surface 1234 of the LF transducer 1212 is unable to enter the acoustic volume 1206. A rear radiating surface 1236 of the LF transducer 1212 radiates acoustic energy into the acoustic volume 1206, and a fourth acoustic seal 1238 is provided between the waveguide 1202 and the cabinet 1204, such that acoustic energy radiated from the rear radiating surface 1236 of the LF transducer 1212 is retained in the acoustic volume 1204.

A second wall 1240 extend outwardly from the rear surface 1224 of the waveguide 1202 and terminates at a free end 1242. In some cases, for example, a flange formed at the free end 1242 of the second wall 1240 may be coupled to a frame of the LF transducer 1212, e.g., using fasteners. In some cases, the fasteners, e.g., screws, may be used to secure the frame of the LF transducer 1212 to the second wall 1240 to form the third acoustic seal 1232. In some cases, the LF transducer 1212, the MF transducer 1210, and the HF transducer 1208 may be mechanically coupled together in the coaxial transducer assembly and the coupling of the LF transducer 1212 to the second wall 1240 helps to ensure that the MF transducer 1210 is tightly coupled to the free end 1226 of the first wall 1222 to form the second acoustic seal 1218 and that the HF transducer 1208 is tightly coupled to the first open end 1214 of the waveguide 1202 to form the first acoustic seal 1216. In other cases, the LF transducer 1212, the MF transducer 1210, and the HF transducer 1208 may each be separately coupled to the waveguide 1202, e.g., via fasteners, and are coupled together via the waveguide 604. In some cases, a gasket may be disposed between the frame of the LF transducer 1212 and the second wall 1240 to help provide the third acoustic seal 1232. The second wall 1240 helps to define a second acoustic channel 1244 that acoustically couples the front radiating surface 1234 of the LF transducer 1212 to a second set of apertures 1246 in the waveguide 1202. In some cases, the second wall 1240 may be a cylindrical wall with a circular cross-sectional area. In other cases, the at least one wall may include a plurality of walls that extend outwardly from the rear surface of the waveguide to define a cross-sectional area in the shape of a closed polygon.

The fourth acoustic seal 1238 is formed by securing a second open end 1248 (a/k/a "mouth") of the waveguide 1202 to the cabinet 1204. In that regard, peripheral edges 1250, near the second open end 1248, of the waveguide 1202 may be secured to the cabinet 1204 using fasteners. In some cases, a gasket may be disposed between the waveguide 1202 and the cabinet 1204 to help ensure that the cabinet 1204 is acoustically sealed. The acoustic volume 1206 including a first region 1252 and a second region 1254. The first region 1252 extending rearward of the LF transducer 1212 and such that the rear radiating surface 1236 of the LF transducer 1212 radiates acoustic energy into the first region 1252. The LF transducer 1212 is completely disposed within the first region 1252 such that no portion of the LF transducer 1212 extends into the second region 1254. The second region 1254 is positioned forward of the front radiating surface 1234 of the LF transducer 1212. The first region 1252 and the second region 1254 being separable by a plane 1256 that extends perpendicular to the motion axes of the transducers. In some cases, the second region 1254 accounts for at least 10% of the total volume of the acoustic volume 1206. For example, the second region may account for at least 25% of the total volume of the acoustic volume 1206, e.g., at least 50%. In certain examples, the second region 1254 accounts for more than 50% of the total volume of the acoustic volume 1206.

Figure 12B:
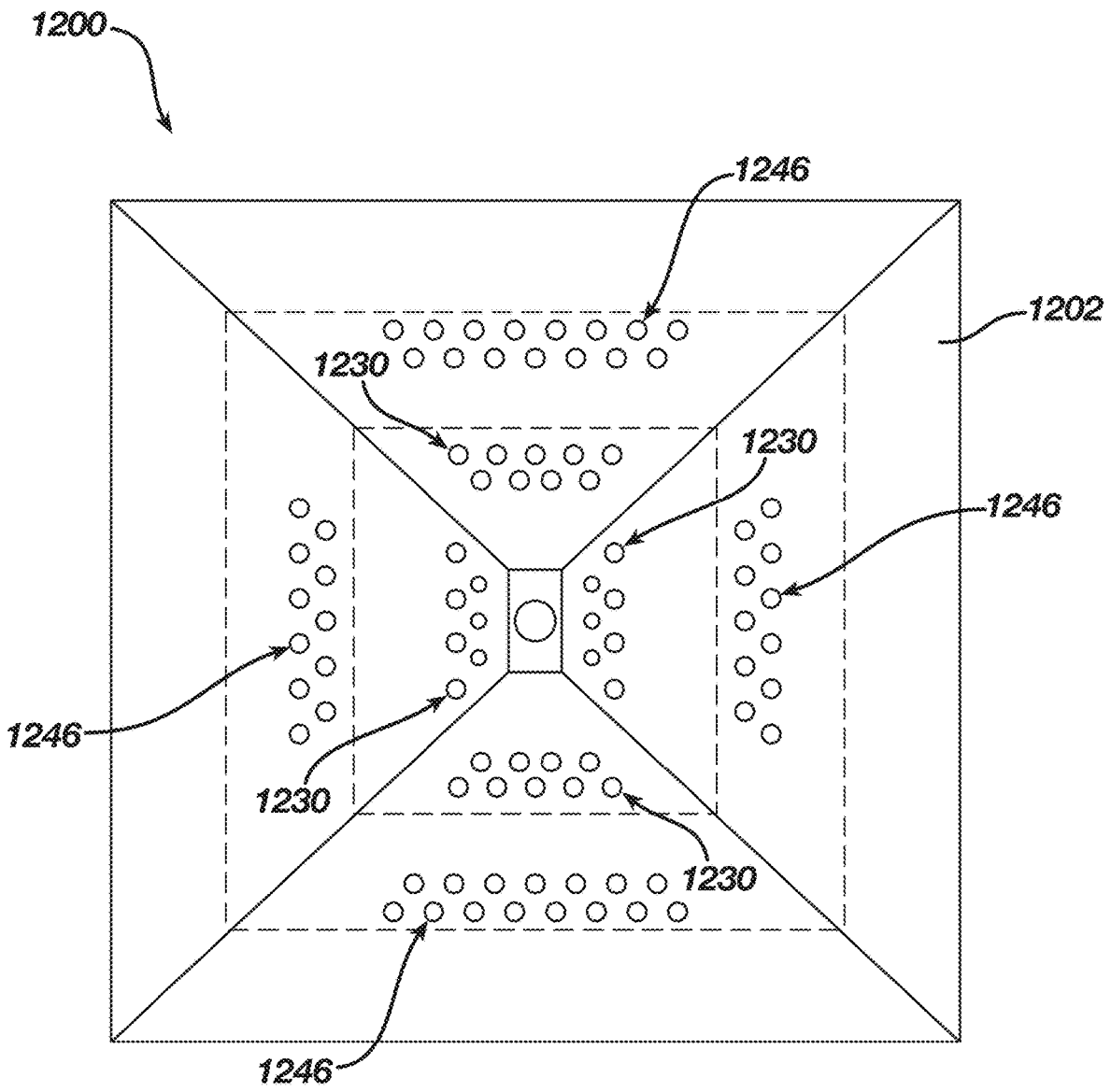
FIG. 12B is a front view of the multi-way loudspeaker of FIG. 12A.

With reference to FIG. 12B, a front view of loudspeaker 1200, the first set of apertures 1230 and the second set of apertures 1246 provided in the waveguide 604 allow the acoustic energy radiated from the front radiating surfaces of MF transducer 1210 and the LF transducer 1212 (FIG. 12A) to pass through the first acoustic channel 1228 and the second acoustic channel 1244, respectively, and out through the front surface of the waveguide 1202, where it merges with high-frequency energy radiated from the HF transducer 1208. Notably, the MF transducer 1210 and the LF transducer 1212 operate below the low-frequency cutoff of the waveguide 1202, such that there is no horn loading on the MF transducer 1210 or the LF transducer 1212. Rather, the waveguide 1202 is acoustically transparent to the MF transducer 1210 and the LF transducer 1212. The waveguide 1202 allows for pattern control of the passband, while also sealing the internal cabinet acoustic volume 1206 (FIG. 12A). The mid-range (a/k/a "mid-frequency") energy off the front radiating surface of the MF transducer 1210 is vented through the first set of apertures 1230. The low frequency energy off the front radiating surface of the LF transducer 1212 is vented through the second set of apertures 1246 in the waveguide 1202. While the shape of the waveguide 1202 dictates the high frequency pattern, the location of the apertures in the waveguide 1202 determine the beam width of the mid and low passbands allowing the desired pattern of the loudspeaker 600 to be extended below the high frequency crossover point and into the mid and low frequency passbands. The pattern of apertures in the waveguide in the horizontal and vertical axis can be modified to achieve different patterns in each axis if desired.

While waveguide configurations have been described which provide a first radiation pattern in a first axial direction and a second, wider radiation pattern in a second axial direction, in some implementations, the waveguide may be configured such that the same radiation pattern is provided in both of a first axial direction (x-axis) and a second axial direction (y-axis).

A number of implementations have been described. Nevertheless, it will be understood that additional modifications may be made without departing from the scope of the inventive concepts described herein, and, accordingly, other implementations are within the scope of the following claims.

What is claimed is:

1. A loudspeaker comprising:

a cabinet;

a coaxial transducer assembly supported in the cabinet and comprising:

a first transducer; and a second transducer coupled to the first transducer and arranged such that respective motion axes of the first and second transducers are coaxial; and a waveguide coupled to the cabinet, wherein the first transducer is arranged at a rear of the second transducer and configured to fire through a center opening of the second transducer, the waveguide is arranged to pass through the center opening of the second transducer and is coupled to the first transducer and configured to provide an acoustic impedance match between the first transducer and free air, wherein the waveguide includes through holes arranged to accommodate fasteners installed via the front of the waveguide, the fasteners engaging and securing the first transducer to the waveguide, wherein a first acoustic seal is formed between the waveguide and the first transducer, and wherein the fasteners pull the second transducer into contact with the waveguide to form a second acoustic seal between the waveguide and the second transducer, wherein the waveguide includes a first plurality of apertures that enables acoustic energy radiated from a first radiating surface of the second transducer to pass through the waveguide and merge with acoustic energy radiated by the first transducer, wherein the first plurality of apertures extends through an expansion region of the waveguide.

2. The loudspeaker of claim 1, wherein a shape of the waveguide controls a radiation pattern of acoustic energy radiated through the waveguide from the first transducer.

3. The loudspeaker of claim 1, wherein a positioning of the first plurality of apertures in the waveguide control a radiation pattern of acoustic energy radiated through the first plurality of apertures from the first radiating surface of the second transducer.

4. The loudspeaker of claim 1, wherein the first plurality of apertures is configured such that a radiation pattern of acoustic energy radiated by the first radiating surface of the second transducer substantially matches a radiation pattern of acoustic energy radiated through the waveguide from the first transducer at a reference location.

5. The loudspeaker of claim 1, wherein the second transducer operates below a low-frequency cutoff of the waveguide, such that there is no horn loading on the second transducer via the waveguide.

6. The loudspeaker of claim 1, wherein the waveguide does not provide an acoustic impedance match between the second transducer and free air.

7. The loudspeaker of claim 1, wherein the first plurality of apertures is configured such that different radiation patterns are provided along different axes.

8. The loudspeaker of claim 7, wherein the first plurality of apertures is configured such that, for acoustic energy radiated from the second transducer, a first radiation pattern is provided in a first axial direction and a second, wider radiation pattern is provided in a second axial direction.

9. The loudspeaker of claim 7, wherein the waveguide is shaped such that, for acoustic energy radiated from the first transducer, a first radiation pattern is provided in a first axial direction and a second, wider radiation pattern is provided in a second axial direction.

10. The loudspeaker of claim 7, further comprising a plurality of pole mounts supported on the cabinet, wherein the loudspeaker is configured to have a first radiation pattern in a first axial direction and a second radiation pattern, wider than the first radiation pattern, in a second axial direction orthogonal to the first axial direction, and wherein a first one of the pole mounts allows the loudspeaker to be mounted to a vertically oriented pole such that the second radiation pattern is arranged in a horizontal direction, and a second one of the pole mounts allows the loudspeaker to be mounted to the vertically oriented pole such that the second radiation pattern is arranged in a vertical direction.

11. The loudspeaker of claim 10, wherein a third one of the pole mounts allows the loudspeaker to be mounted to the vertically oriented pole such that the second radiation pattern is arranged in the vertical direction.

12. The loudspeaker of claim 11, wherein the first one of the pole mounts is supported on a first surface of the cabinet, wherein the second one of the pole mounts is supported on a second surface of the cabinet adjacent to the first surface, and wherein the third one of the pole mounts in support on a third surface of the cabinet opposite the second surface.

13. The loudspeaker of claim 1, further comprising a Helmholtz resonator acoustically coupled to the first radiating surface of the second transducer.

14. The loudspeaker of claim 1, wherein the first transducer is a tweeter and the second transducer is a woofer.

15. The loudspeaker of claim 1, further comprising a third transducer disposed between the first transducer and the second transducer and arranged such that respective motion axes of the first, second, and third transducers are coaxial.

16. The loudspeaker of claim 15, further comprising a second plurality of apertures that enables acoustic energy radiated from a first radiating surface of the third transducer to pass through the waveguide and merge with acoustic energy radiated by the first and second transducers.

17. The loudspeaker of claim 16, wherein a third acoustic seal is formed between the waveguide and the cabinet such that the waveguide and the cabinet together at least partially define a sealed acoustic volume within which the coaxial transducer assembly is disposed, and wherein a fourth acoustic seal is formed between the waveguide and the third transducer such that the first radiating surface of the third transducer is acoustically isolated from the first radiating surface of the second transducer.

18. The loudspeaker of claim 16, wherein the first transducer is a tweeter, the second transducer is a woofer, and the third transducer is a mid-range transducer.

19. The loudspeaker of claim 16, wherein a shape of the waveguide controls a radiation pattern of acoustic energy radiated through the waveguide from the first transducer, wherein a positioning of the first plurality of apertures in the waveguide control a radiation pattern of acoustic energy radiated through the first plurality of apertures from the first radiating surface of the second transducer, and wherein a positioning of the second plurality of apertures in the waveguide control a radiation pattern of acoustic energy radiated through the second plurality of apertures from the first radiating surface of the third transducer.

20. The loudspeaker of claim 1, further comprising an acoustically transparent grille, and wherein the waveguide comprises:

a mouth; and a raised region disposed at a periphery of the mouth and configured to support the acoustically transparent grille.

21. A loudspeaker comprising:

a cabinet;

a coaxial transducer assembly supported in the cabinet and comprising:

a first transducer; and a second transducer coupled to the first transducer and arranged such that respective motion axes of the first and second transducers are coaxial;

a waveguide coupled to the cabinet such that the waveguide and the cabinet together at least partially define a sealed acoustic volume within which the coaxial transducer assembly is disposed, wherein the waveguide passes through a center opening of the second transducer and is coupled to the first transducer and configured to provide an acoustic impedance match between the first transducer and free air, wherein the waveguide includes through holes arranged to accommodate fasteners installed via the front of the waveguide, the fasteners engaging and securing the first transducer to the waveguide, and wherein the fasteners pull the second transducer into contact with the waveguide to form an acoustic seal between the waveguide and the second transducer, wherein the waveguide includes a plurality of apertures than enables acoustic energy radiated from a first radiating surface of the second transducer to pass through the waveguide and merge with acoustic energy radiated by the first transducer, wherein a shape of the waveguide controls a radiation pattern of acoustic energy radiated from the first transducer, wherein a location of the apertures in the waveguide control a radiation pattern of acoustic energy radiated from the second transducer.

22. The loudspeaker of claim 21, wherein the second radiation pattern is axially symmetric.

23. A loudspeaker comprising:

a cabinet;

one or more transducers supported by the cabinet;

a waveguide arranged to pass through a center opening of a first one of the one or more transducers and to couple to a second one of the one or more transducers and to provide an acoustic impedance match between the second one of the one or more transducers and free air, wherein the waveguide includes through holes arranged to accommodate fasteners installed via the front of the waveguide, the fasteners engaging and securing the waveguide to the second one of the one or more transducers and wherein the fasteners pull each of the one or more transducers into contact with the waveguide to form an acoustic seal between the waveguide and each of the one or more transducers; and a plurality of pole mounts supported by the cabinet that allow the cabinet to be mounted upon a pole in a plurality of orientations, wherein the loudspeaker is configured to have a first radiation pattern in a first axial direction and a second radiation pattern, wider than the first radiation pattern, in a second axial direction orthogonal to the first axial direction, and wherein the plurality of pole mounts comprises:

a first pole mount supported on a first surface of the cabinet and configured to allow the loudspeaker to be mounted to a vertically oriented pole such that the second radiation pattern is arranged in a horizontal orientation, a second pole mount supported on a second surface of the cabinet adjacent to the first surface and configured to allow the loudspeaker to be mounted to the vertically oriented pole such that the second radiation pattern is arranged in a first vertical orientation, and a third pole mount support on a third surface of the cabinet opposite the second surface and configured to allow the loudspeaker to be mounted to the vertically oriented pole such that the second radiation pattern is arranged in a second vertical orientation.

* * * * *